US010012032B2

(12) United States Patent
Yeh et al.

(10) Patent No.: US 10,012,032 B2
(45) Date of Patent: Jul. 3, 2018

(54) DOWNHOLE FLOW CONTROL, JOINT ASSEMBLY AND METHOD

(71) Applicants: Charles S. Yeh, Spring, TX (US); Michael D. Barry, The Woodlands, TX (US); Michael T. Hecker, Tomball, TX (US); Tracy J. Moffett, Sugar Land, TX (US)

(72) Inventors: Charles S. Yeh, Spring, TX (US); Michael D. Barry, The Woodlands, TX (US); Michael T. Hecker, Tomball, TX (US); Tracy J. Moffett, Sugar Land, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 593 days.

(21) Appl. No.: 14/418,834

(22) PCT Filed: Oct. 11, 2013

(86) PCT No.: PCT/US2013/064674
§ 371 (c)(1),
(2) Date: Jan. 30, 2015

(87) PCT Pub. No.: WO2014/066071
PCT Pub. Date: May 1, 2014

(65) Prior Publication Data

US 2015/0218909 A1 Aug. 6, 2015

Related U.S. Application Data

(60) Provisional application No. 61/719,274, filed on Oct. 26, 2012, provisional application No. 61/878,461, filed on Sep. 16, 2013.

(51) Int. Cl.
*E21B 17/02* (2006.01)
*E21B 43/08* (2006.01)
(Continued)

(52) U.S. Cl.
CPC ..... *E21B 17/02* (2013.01); *E21B 17/042* (2013.01); *E21B 17/18* (2013.01); *E21B 33/124* (2013.01);
(Continued)

(58) Field of Classification Search
CPC ..... E21B 17/02; E21B 17/023; E21B 17/04; E21B 17/042; E21B 17/18; E21B 43/08
See application file for complete search history.

(56) References Cited

U.S. PATENT DOCUMENTS 4,945,991 A 8/1990 Jones
5,082,052 A 1/1992 Jones et al.
(Continued)

FOREIGN PATENT DOCUMENTS

EP 1 160 417 A2 12/2001
WO WO 2012/082305 6/2012
WO WO 2013/055451 4/2013

OTHER PUBLICATIONS

Barry, M.D. et al. (2007), "Openhole Gravel Packing with Zonal Isolation," 2007 SPE Annual Technical Conference and Exhibition, SPE 110460, Anaheim, CA, 10 pgs.
(Continued)

*Primary Examiner* — Giovanna C. Wright
*Assistant Examiner* — Tara E Schimpf
(74) *Attorney, Agent, or Firm* — ExxonMobil Upstream Research Company—Law Department

(57) ABSTRACT

A method for completing a wellbore in a subsurface formation includes providing a first base pipe and a second base pipe. Each base pipe comprises a tubular body forming a primary flow path and has transport conduits along an outer diameter for transporting fluids as a secondary flow path. The method also includes connecting the base pipes using a coupling assembly. The coupling assembly has a manifold,
(Continued)

and a flow port adjacent the manifold that places the primary flow path in fluid communication with the secondary flow path. The method also includes running the base pipes into the wellbore, and then causing fluid to travel between the primary and secondary flow paths. A wellbore completion apparatus is also provided that allows for control of fluid between the primary and secondary flow paths.

37 Claims, 14 Drawing Sheets

(51) Int. Cl.

| | |
|---|---|
| ***E21B 43/14*** | (2006.01) |
| ***E21B 17/042*** | (2006.01) |
| ***E21B 17/18*** | (2006.01) |
| ***E21B 33/124*** | (2006.01) |
| ***E21B 34/12*** | (2006.01) |
| ***E21B 43/16*** | (2006.01) |
| ***E21B 43/24*** | (2006.01) |
| ***E21B 34/06*** | (2006.01) |
| ***E21B 43/04*** | (2006.01) |
| *E21B 34/00* | (2006.01) |

(52) U.S. Cl.

CPC ..... *E21B 34/06* (2013.01); *E21B 34/12* (2013.01); *E21B 43/04* (2013.01); *E21B 43/08* (2013.01); *E21B 43/084* (2013.01); *E21B 43/086* (2013.01); *E21B 43/088* (2013.01); *E21B 43/14* (2013.01); *E21B 43/162* (2013.01); *E21B 43/168* (2013.01); *E21B 43/24* (2013.01); *E21B 2034/007* (2013.01)

(56) References Cited

U.S. PATENT DOCUMENTS 5,113,315 A 5/1992 Capp et al.
5,113,935 A 5/1992 Jones et al.
5,161,613 A 11/1992 Jones
5,161,618 A 11/1992 Jones et al.
5,333,688 A 8/1994 Jones et al.
5,333,689 A 8/1994 Jones et al.
5,396,954 A 3/1995 Brooks
5,417,284 A 5/1995 Jones
5,419,394 A 5/1995 Jones
5,435,391 A 7/1995 Jones
5,476,143 A 12/1995 Sparlin et al.
5,479,986 A 1/1996 Gano et al.
5,515,915 A 5/1996 Jones et al.
5,560,427 A 10/1996 Jones
5,588,487 A 12/1996 Bryant
5,664,628 A 9/1997 Koehler et al.
5,690,175 A 11/1997 Jones
5,803,179 A 9/1998 Echols et al.
5,842,516 A 12/1998 Jones
5,848,645 A 12/1998 Jones
5,868,200 A * 2/1999 Bryant ..... E21B 43/04 166/242.3
5,881,809 A 3/1999 Gillespie et al.
5,890,533 A 4/1999 Jones
6,059,032 A 5/2000 Jones
6,220,345 B1 4/2001 Jones et al.
6,227,303 B1 5/2001 Jones
6,298,916 B1 10/2001 Tibbles et al.
6,405,800 B1 6/2002 Walker et al.
6,409,219 B1 6/2002 Broome et al.
6,464,007 B1 10/2002 Jones
6,464,261 B1 10/2002 Dybevik et al.
6,494,265 B2 12/2002 Wilson et al.
6,513,599 B1 2/2003 Bixenman et al.
6,516,881 B2 2/2003 Hailey, Jr.
6,557,634 B2 5/2003 Hailey, Jr. et al.
6,575,251 B2 6/2003 Watson et al.
6,581,689 B2 6/2003 Hailey, Jr.
6,588,506 B2 7/2003 Jones
6,644,406 B1 11/2003 Jones
6,666,274 B2 12/2003 Hughes
6,675,245 B1 1/2004 Schmidt
6,695,067 B2 2/2004 Johnson et al.
6,749,023 B2 6/2004 Nguyen et al.
6,749,024 B2 6/2004 Bixenman
6,752,207 B2 6/2004 Danos et al.
6,755,245 B2 6/2004 Nguyen et al.
6,814,139 B2 11/2004 Hejl et al.
6,814,144 B2 11/2004 Jones
6,817,410 B2 11/2004 Wetzel et al.
6,848,510 B2 2/2005 Bixenman et al.
6,883,608 B2 4/2005 Parlar et al.
6,923,262 B2 8/2005 Broome et al.
6,983,796 B2 1/2006 Bayne et al.
6,986,390 B2 1/2006 Doanne et al.
7,048,061 B2 5/2006 Bode et al.
7,100,691 B2 9/2006 Nguyen et al.
7,104,324 B2 9/2006 Wetzel et al.
7,108,060 B2 9/2006 Jones
7,147,054 B2 12/2006 Wang et al.
7,152,677 B2 12/2006 Parlar et al.
7,207,383 B2 4/2007 Hurst et al.
7,243,715 B2 7/2007 Wang et al.
7,243,723 B2 7/2007 Surjaatmadja et al.
7,243,724 B2 7/2007 McGregor et al.
7,243,732 B2 7/2007 Richard
7,264,061 B2 9/2007 Dybevik et al.
7,278,479 B2 10/2007 Kvernstuen et al.
7,279,482 B2 10/2007 Dolezal et al.
7,343,983 B2 3/2008 Livingstone
7,363,974 B2 4/2008 Wang et al.
7,370,700 B2 5/2008 Hurst et al.
7,407,007 B2 8/2008 Tibbles
7,426,962 B2 9/2008 Moen et al.
7,431,058 B2 10/2008 Holting
7,431,085 B2 10/2008 Coronado et al.
7,441,605 B2 10/2008 Coronado et al.
7,464,752 B2 12/2008 Dale et al.
7,475,725 B2 1/2009 Yeh et al.
7,493,959 B2 2/2009 Johnson et al.
7,562,709 B2 7/2009 Saebi et al.
7,584,799 B2 9/2009 Coronado et al.
7,591,321 B2 9/2009 Whitsitt et al.
7,597,141 B2 10/2009 Rouse et al.
7,661,476 B2 2/2010 Yeh et al.
7,735,559 B2 6/2010 Malone
7,845,407 B2 12/2010 Bunnell et al.
7,870,898 B2 1/2011 Yeh et al.
7,891,420 B2 2/2011 Dale et al.
7,926,565 B2 4/2011 Duan et al.
7,938,184 B2 5/2011 Yeh et al.
7,971,642 B2 7/2011 Yeh et al.
7,984,760 B2 7/2011 Haeberle et al.
8,011,437 B2 9/2011 Yeh et al.
8,127,831 B2 3/2012 Haeberle et al.
8,186,429 B2 5/2012 Yeh et al.
8,215,406 B2 7/2012 Dale et al.
8,245,778 B2 8/2012 Yeh et al.
8,347,956 B2 1/2013 Yeh et al.
8,356,664 B2 1/2013 Yeh et al.
8,430,160 B2 4/2013 Yeh et al.
8,522,867 B2 9/2013 Yeh et al.
2003/0173075 A1 9/2003 Morvant et al.
2004/0140089 A1 7/2004 Gunneroed
2005/0028977 A1 2/2005 Ward
2005/0061501 A1 3/2005 Ward et al.
2005/0082060 A1 4/2005 Ward et al.
2007/0114020 A1 5/2007 Brekke
2008/0314589 A1 12/2008 Guignard et al.
2009/0008084 A1 1/2009 Dybevik et al.
2009/0159279 A1 6/2009 Assal
2009/0159298 A1 6/2009 Assal
2009/0283279 A1 11/2009 Patel et al.
2010/0065284 A1 3/2010 Freyer
2010/0096119 A1 4/2010 Sevre et al.

(56) References Cited

U.S. PATENT DOCUMENTS

| | | | | |
|---|---|---|---|---|
| 2010/0155064 | A1 | 6/2010 | Nutley et al. | |
| 2011/0011577 | A1 | 1/2011 | Dusterhoft et al. | |
| 2011/0132616 | A1 | 6/2011 | Yeh et al. | |
| 2012/0217010 | A1 | 8/2012 | Haeberle et al. | |
| 2013/0248178 | A1 | 9/2013 | Hecker et al. | |
| 2013/0248179 | A1 | 9/2013 | Yeh et al. | |
| 2014/0027115 | A1* | 1/2014 | Sanders | E21B 43/04 166/278 |
| 2014/0262332 | A1* | 9/2014 | McNamee | E21B 43/04 166/378 |

OTHER PUBLICATIONS

Hecker, M.T. et al. (2010), "Extending Openhole Gravel Packing Capability: Initial Field Installation of Internal Shunt Alternate Path Technology," SPE Annual Technical Conference and Exhibition, SPE 135102, Florence, Italy, 9 pgs.

Okoroh, K. et al. (2013), "First Commercial Installation of MazeFlo Technology for Remedial Sand Control Application in Ubit Field," Nigeria Annual International Conference and Exhibition, SPE 167532, Lagos, Nigeria, 7 pges.

RU 2 160 360 C2, English translation of Abstract, 1 page.

* cited by examiner

DOWNHOLE FLOW CONTROL, JOINT ASSEMBLY AND METHOD

STATEMENT OF RELATED APPLICATIONS

This application is the National Stage of International Application No. PCT/US2013/064674, that published as WO 2014/066071, filed 11 Oct. 2013, claims the benefit of U.S. Provisional Pat. Appl. No. 61/719,274, filed Oct. 26, 2012, and U.S. Provisional Pat. Appl. No. 61/878,461 filed Sep. 16, 2013, and both are incorporated by reference herein in their entirety.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field of the Invention

The present disclosure relates to the field of well completions. More specifically, the present invention relates to the isolation of formations in connection with wellbores that have been completed through multiple zones. The application also relates to a wellbore completion apparatus which incorporates bypass technology but which allows for the control of fluids through primary and secondary flow paths along the wellbore.

Discussion of Technology

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the formation. A cementing operation is typically conducted in order to fill or "squeeze" the annular area with cement. The combination of cement and casing strengthens the wellbore and facilitates the isolation of formations behind the casing.

It is common to place several strings of casing having progressively smaller outer diameters into the wellbore. The process of drilling and then cementing progressively smaller strings of casing is repeated several times until the well has reached total depth. The final string of casing, referred to as a production casing, is cemented in place and perforated. In some instances, the final string of casing is a liner, that is, a string of casing that is not tied back to the surface.

As part of the completion process, a wellhead is installed at the surface. The wellhead controls the flow of production fluids to the surface, or the injection of fluids into the wellbore. Fluid gathering and processing equipment such as pipes, valves and separators are also provided. Production operations may then commence.

It is sometimes desirable to leave the bottom portion of a wellbore open. In open-hole completions, a production casing is not extended through the producing zones and perforated; rather, the producing zones are left uncased, or "open." A production string or "tubing" is then positioned inside the open wellbore extending down below the last string of casing.

There are certain advantages to open-hole completions versus cased-hole completions. First, because open-hole completions have no perforation tunnels, formation fluids can converge on the wellbore radially 360 degrees. This has the benefit of eliminating the additional pressure drop associated with converging radial flow and then linear flow through particle-filled perforation tunnels. The reduced pressure drop associated with an open-hole completion virtually guarantees that it will be more productive than an unstimulated, cased hole in the same formation.

Second, open-hole techniques are oftentimes less expensive than cased hole completions. For example, the use of gravel packs eliminates the need for cementing, perforating, and post-perforation clean-up operations. Alternatively, the use of a perforated base pipe along the open hole wellbore helps maintain the integrity of the wellbore while allowing substantially 360 degree radial formation exposure.

It is desirable in some open-hole completions to isolate selected zones along the wellbore. For example, it is sometimes desirable to isolate an interval from the production of formation fluids into the wellbore. Annular zonal isolation may also be desired for production allocation, production/injection fluid profile control, selective stimulation, or gas control. This may be done through the use of packers (or a zonal isolation apparatus) that has bypass technology. The bypass technology may employ fluid transport conduits that permit fluids to flow through a sealing element of the packer and across an isolated zone.

The use of bypass technology with a zonal isolation apparatus has been developed in the context of gravel packing. This technology is practiced under the name Alternate Path®. Alternate Path® technology employs shunt tubes, or alternate flow channels, that allow a gravel slurry to bypass selected areas, e.g., premature sand bridges or packers, along a wellbore. Such fluid bypass technology is described, for example, in U.S. Pat. No. 5,588,487 and U.S. Pat. No. 7,938,184. Additional references which discuss alternate flow channel technology include U.S. Pat. Nos. 8,215,406; 8,186,429; 8,127,831; 8,011,437; 7,971,642; 7,938,184; 7,661,476; 5,113,935; 4,945,991; U.S. Pat. Publ. No. 2012/0217010; U.S. Pat. Publ. No. 2009/0294128; M. T. Hecker, et al., "Extending Openhole Gravel-Packing Capability: Initial Field Installation of Internal Shunt Alternate Path Technology," SPE Annual Technical Conference and Exhibition, SPE Paper No. 135,102 (September 2010); and M. D. Barry, et al., "Open-hole Gravel Packing with Zonal Isolation," SPE Paper No. 110,460 (November 2007). The Alternate Path® technology enables a true zonal isolation in multi-zone, openhole gravel pack completions.

In some open-hole completions, a gravel pack is not employed. This may be due to the formation being sufficiently consolidated that a sand screen and pack are not required. Alternatively, this may be due to economic limitations. In either instance, it is still desirable to run tubular bodies down the wellbore to support packers or other tools, and to provide flow control between a main base pipe and the annulus formed between the base pipe and the surrounding wellbore.

Therefore, a need exists for a joint assembly that provides flow control between a base pipe and a surrounding annular region using fluid bypass technology. This may be for the production of formation fluids, the injection of fluids into a formation, or for the placement of wellbore treatment fluids along a formation. A need further exists for a downhole flow control system that provides for fluid communication between a primary flow path within a base pipe and the alternate flow path of fluid transport conduits. Additionally, a need exists for a method of completing a wellbore wherein a joint assembly is placed along an open hole formation that uses selected fluid communication between the base pipe and bypass channels.

SUMMARY OF THE INVENTION

A joint assembly is first provided herein. The joint assembly resides within a wellbore. The joint assembly has particular utility in connection with the control of fluid flow between an internal bore of a base pipe and an annular region outside of the base pipe, all residing within a surrounding open-hole portion of the wellbore. The open-hole portion extends through one, two, or more subsurface intervals.

The joint assembly includes a first base pipe and a second base pipe. The two base pipes are connected in series. Each base pipe comprises a tubular body. The tubular bodies each have a first end, a second end and a bore defined there between. The bores form a primary flow path for fluids.

The joint assembly preferably also includes a load sleeve and a torque sleeve. The load sleeve is mechanically connected proximate to the first end of the second base pipe, while the torque sleeve is mechanically connected proximate to the second end of the first base pipe. The load sleeve and the torque sleeve, in turn, are connected by means of a coupling joint. Preferably, the load sleeve and the torque sleeve are bolted into the respective base pipes to prevent relative rotational movement.

Each of the load sleeve and the torque sleeve comprises an elongated cylindrical body. The sleeves each have an outer diameter, a first and second end, and a bore extending from the first end to the second end. The bore forms an inner diameter in each of the elongated bodies. Each of the load sleeve and the torque sleeve also includes at least one transport conduit, with each of the transport conduits extending through the respective sleeve from the first end to the second end.

The intermediate coupling joint also comprises a cylindrical body that defines a bore therein. The bore is in fluid communication with the primary flow path. A co-axial sleeve is concentrically positioned around a wall of the tubular body, forming an annual region between the tubular body and the sleeve. The annular region defines a manifold region, with the manifold region placing the transport conduits of the load sleeve and the torque sleeve in fluid communication. Preferably, the co-axial sleeve is bolted into the tubular body, preserving spacing of the manifold region.

The load sleeve, the torque sleeve and the intermediate coupling joint form a coupling assembly that operatively connect the first and second base pipes along an open-hole portion of the wellbore. In one aspect, each of the load sleeve and the torque sleeve presents shoulders that receive the opposing ends of the coupling joint. O-rings may be used along the shoulders to preserve a fluid seal. At the same time, the coupling joint has opposing female threads for connecting the first and second base pipes.

In the present invention, the joint assembly further includes a flow port. The flow port resides adjacent the manifold and places the primary flow path in fluid communication with the secondary flow path. The manifold region also places respective transport conduits of the base pipes in fluid communication. Preferably, the flow port is in the tubular body of the coupling joint, although it may reside proximate an end of one or both of the threadedly connected base pipes.

In a preferred embodiment, the tubular bodies comprise blank pipes or, alternatively, perforated base pipes. The base pipes may be, for example, a series of joints threadedly connected to form the primary flow path. Alternatively, the tubular bodies may be slotted pipes having a filter medium radially around the pipes and along a substantial portion of the pipes so as to form a sand screen.

The joint assembly is arranged to have Alternate Flow® technology. In this respect, each base pipe has at least two transport conduits. The transport conduits reside along an outer diameter of the base pipes, and are configured to transport fluids as a secondary flow path.

Various arrangements for the transport conduits may be used. Preferably, the at least two transport conduits represent six conduits radially disposed about the base pipe. The transport conduits may have different diameters and different lengths.

In one aspect, each of the transport conduits along the second base pipe extends substantially along the length of the second base pipe. In another aspect, each of the transport conduits along the first base pipe extends substantially along the length of the first base pipe, but one of the transport conduits has a nozzle intermediate the first and second ends of the first base pipe. In still another aspect, at least one of the transport conduits along the first base pipe has an outlet end intermediate the first and second ends of the first base pipe.

In one embodiment, the joint assembly further comprises an inflow control device. The inflow control device resides adjacent an opening in the flow port, or may even define the flow port. The inflow control device is configured to increase or decrease fluid flow through the flow port.

The joint assembly preferably also includes a packer assembly. The packer assembly comprises at least one sealing element. The sealing elements are configured to be actuated to engage a surrounding wellbore wall. The packer assembly also has an inner mandrel. Further the packer assembly has at least one transport conduit. The transport conduits extend along the inner mandrel and are in fluid communication with the transport conduits of the base pipes.

The sealing element for the packer assembly may include a mechanically-set packer. More preferably, the packer assembly has two mechanically-set packers or annular seals. These represent an upper packer and a lower packer. Each mechanically-set packer has a sealing element that may be, for example, from about 6 inches (15.2 cm) to 24 inches (61.0 cm) in length. Each mechanically-set packer also has an inner mandrel in fluid communication with the base pipe of the sand screens and the base pipe of the joint assembly.

Intermediate the at least two mechanically-set packers may optionally be at least one swellable packer element. The swellable packer element is preferably about 3 feet (0.91 meters) to 40 feet (12.2 meters) in length. In one aspect, the swellable packer element is fabricated from an elastomeric material. The swellable packer element is actuated over time in the presence of a fluid such as water, gas, oil, or a chemical. Swelling may take place, for example, should one of the mechanically-set packer elements fails. Alternatively, swelling may take place over time as fluids in the formation surrounding the swellable packer element contact the swellable packer element.

A method for completing a wellbore in a subsurface formation is also provided herein. The wellbore preferably includes a lower portion completed as an open-hole.

In one aspect, the method includes providing a first base pipe and a second base pipe. The two base pipes are connected in series. Each base pipe comprises a tubular body. The tubular bodies each have a first end, a second end and a bore defined there between. The bores form a primary flow path for fluids. In a preferred embodiment, the tubular bodies comprise perforated base pipes.

Each of the base pipes also has at least two transport conduits. The transport conduits reside along an outer diameter of the base pipes for transporting fluids as a secondary flow path. Various arrangements for the transport conduits may be used. As discussed above, the transport conduits may have different diameters and different lengths.

The method also includes operatively connecting the second end of the first base pipe to the first end of the second base pipe. This is done by means of a coupling assembly. In one embodiment, the coupling assembly includes a load sleeve, a torque sleeve, and an intermediate coupling joint. The load sleeve, the torque sleeve, and the coupling joint form a coupling assembly as described above. Of note, the coupling joint includes a flow port residing adjacent the manifold region. The flow port places the primary flow path in fluid communication with the secondary flow path. The manifold region also places respective transport conduits of the base pipes in fluid communication.

The method further includes running the base pipes into the wellbore. The method then includes causing fluid to travel between the primary and secondary flow paths. In one aspect, the method further comprises producing hydrocarbon fluids through the base pipes of the first and second base pipes from at least one interval along the wellbore. Producing hydrocarbon fluids causes hydrocarbon fluids to travel from the secondary flow path to the primary flow path. In another aspect, the method further comprises injecting a fluid through the base pipes and into the wellbore along at least one interval. Injecting the fluid causes fluids to travel from the primary flow path to the secondary flow path.

In one embodiment, the joint assembly further comprises an inflow control device. The inflow control device resides adjacent an opening in the flow port. The inflow control device is configured to increase or decrease fluid flow through the flow port. The inflow control device may be, for example, a sliding sleeve or a valve. The method may then further comprise adjusting the inflow control device to increase or decrease fluid flow through the flow port. This may be done through a radio frequency signal, a mechanical shifting tool, or hydraulic pressure.

Optionally, the method further includes providing a packer assembly. The packer assembly is also in accordance with the packer assembly described above in its various embodiments. The packer assembly includes at least one, and preferably two, mechanically-set packers. For example, each packer will have an inner mandrel, alternate flow channels around the inner mandrel, and a sealing element external to the inner mandrel.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

Figure 1:
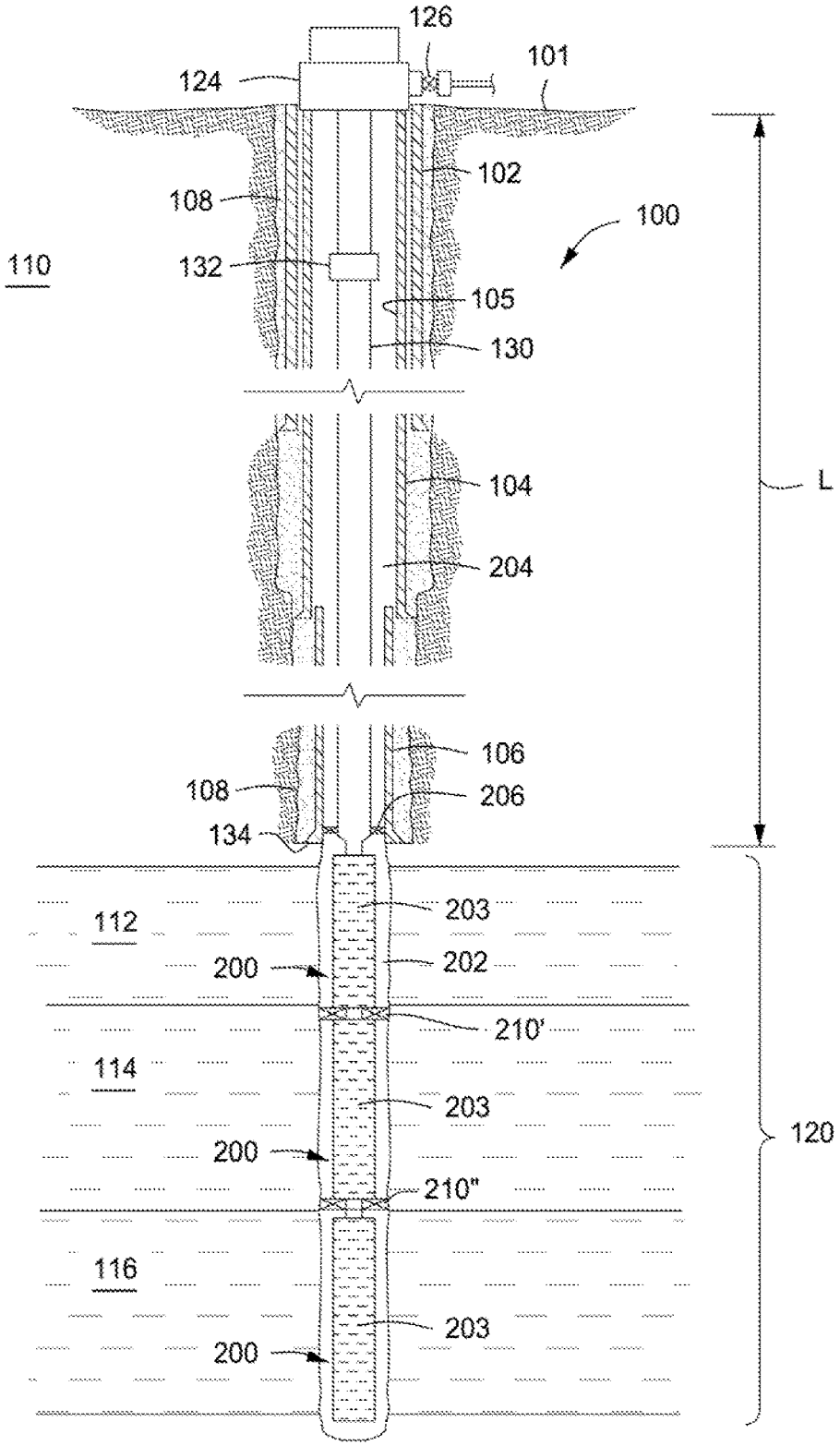
FIG. 1 is a cross-sectional view of an illustrative wellbore. The wellbore has been drilled through three different subsurface intervals, each interval being under formation pressure and containing fluids.

As used herein, the term "hydrocarbon" refers to an organic compound that includes primarily, if not exclusively, the elements hydrogen and carbon. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coal bed methane, shale oil, pyrolysis oil, pyrolysis gas, a pyrolysis product of coal, and other hydrocarbons that are in a gaseous or liquid state.

As used herein, the term "fluid" refers to gases, liquids, and combinations of gases and liquids, as well as to combinations of gases and solids, and combinations of liquids and solids.

As used herein, the term "subsurface" refers to geologic strata occurring below the earth's surface.

The term "subsurface interval" refers to a formation or a portion of a formation wherein formation fluids may reside. The fluids may be, for example, hydrocarbon liquids, hydrocarbon gases, aqueous fluids, or combinations thereof.

As used herein, the term "wellbore" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

The terms "tubular member" or "tubular body" refer to any pipe or tubular device, such as a joint of casing or base pipe, a portion of a liner, or a pup joint.

The terms "sand control device" or "sand control segment" mean any elongated tubular body that permits an inflow of fluid into an inner bore or a base pipe while filtering out predetermined sizes of sand, fines and granular debris from a surrounding formation. A wire wrap screen around a slotted base pipe is an example of a sand control segment.

The term "transport conduits" means any collection of manifolds and/or alternate flow paths that provide fluid communication through or around a wellbore tool to allow a gravel slurry or other fluid to bypass the wellbore tool or any premature sand bridge in an annular region. Examples of such wellbore tools include (i) a packer having a sealing element, (ii) a sand screen or slotted pipe, and (iii) a blank pipe, with or without an outer protective shroud.

Description Of Specific Embodiments

The inventions are described herein in connection with certain specific embodiments. However, to the extent that the following detailed description is specific to a particular embodiment or a particular use, such is intended to be illustrative only and is not to be construed as limiting the scope of the inventions.

Certain aspects of the inventions are also described in connection with various figures. In certain of the figures, the top of the drawing page is intended to be toward the surface, and the bottom of the drawing page toward the well bottom. While wells commonly are completed in substantially vertical orientation, it is understood that wells may also be inclined and or even horizontally completed. When the descriptive terms "up and down" or "upper" and "lower" or similar terms are used in reference to a drawing or in the claims, they are intended to indicate relative location on the drawing page or with respect to claim terms, and not necessarily orientation in the ground, as the present inventions have utility no matter how the wellbore is orientated.

FIG. 1 is a cross-sectional view of an illustrative wellbore 100. The wellbore 100 defines a bore 105 that extends from a surface 101, and into the earth's subsurface 110. The wellbore 100 is completed to have an open-hole portion 120 at a lower end of the wellbore 100. The wellbore 100 has been formed for the purpose of producing hydrocarbons for processing or commercial sale. A string of production tubing 130 is provided in the bore 105 to transport production fluids from the open-hole portion 120 up to the surface 101.

The wellbore 100 includes a well tree, shown schematically at 124. The well tree 124 includes a shut-in valve 126. The shut-in valve 126 controls the flow of production fluids from the wellbore 100. In addition, a subsurface safety valve 132 is provided to block the flow of fluids from the production tubing 130 in the event of a rupture or catastrophic event above the subsurface safety valve 132. The wellbore 100 may optionally have a pump (not shown) within or just above the open-hole portion 120 to artificially lift production fluids from the open-hole portion 120 up to the well tree 124.

The wellbore 100 has been completed by setting a series of pipes into the subsurface 110. These pipes include a first string of casing 102, sometimes known as surface casing or a conductor. These pipes also include at least a second 104 and a third 106 string of casing. These casing strings 104, 106 are intermediate casing strings that provide support for walls of the wellbore 100. Intermediate casing strings 104, 106 may be hung from the surface, or they may be hung from a next higher casing string using an expandable liner or liner hanger. It is understood that a pipe string that does not extend back to the surface (such as casing string 106) is normally referred to as a "liner."

In the illustrative wellbore arrangement of FIG. 1, intermediate casing string 104 is hung from the surface 101, while casing string 106 is hung from a lower end of casing string 104. Additional intermediate casing strings (not shown) may be employed. The present inventions are not limited to the type of casing arrangement used.

Each string of casing 102, 104, 106 is set in place through a cement column 108. The cement column 108 isolates the various formations of the subsurface 110 from the wellbore 100 and each other. The column of cement 108 extends from the surface 101 to a depth "L" at a lower end of the casing string 106. It is understood that some intermediate casing strings may not be fully cemented.

An annular region 204 (seen in FIG. 2) is formed between the production tubing 130 and the casing string 106. A production packer 206 seals the annular region 204 near the lower end "L" of the casing string 106.

In many wellbores, a final casing string known as production casing is cemented into place at a depth where subsurface production intervals reside. However, the illustrative wellbore 100 is completed as an open-hole wellbore. Accordingly, the wellbore 100 does not include a final casing string along the open-hole portion 120.

In the illustrative wellbore 100, the open-hole portion 120 traverses three different subsurface intervals. These are indicated as upper interval 112, intermediate interval 114, and lower interval 116. Upper interval 112 and lower interval 116 may, for example, contain valuable oil deposits sought to be produced, while intermediate interval 114 may contain primarily water or other aqueous fluid within its pore volume. This may be due to the presence of native water zones, high permeability streaks or natural fractures in the aquifer, or fingering from injection wells. In this instance, there is a probability that water will invade the wellbore 100.

Alternatively, upper 112 and intermediate 114 intervals may contain hydrocarbon fluids sought to be produced, processed and sold, while lower interval 116 may contain some oil along with ever-increasing amounts of water. This may be due to coning, which is a rise of near-well hydrocarbon-water contact. In this instance, there is again the possibility that water will invade the wellbore 100.

Alternatively still, upper 112 and lower 116 intervals may be producing hydrocarbon fluids from a sand or other permeable rock matrix, while intermediate interval 114 may represent a non-permeable shale or otherwise be substantially impermeable to fluids.

In any of these events, it is desirable for the operator to isolate selected intervals. In the first instance, the operator will want to isolate the intermediate interval 114 from the production string 130 and from the upper 112 and lower 116 intervals (by use of packer assemblies 210' and 210") so that primarily hydrocarbon fluids may be produced through the wellbore 100 and to the surface 101. In the second instance, the operator will eventually want to isolate the lower interval 116 from the production string 130 and the upper 112 and intermediate 114 intervals so that primarily hydrocarbon fluids may be produced through the wellbore 100 and to the surface 101. In the third instance, the operator will want to isolate the upper interval 112 from the lower interval 116, but need not isolate the intermediate interval 114.

In the illustrative wellbore 100 of FIG. 1, a series of base pipes 200 extends through the intervals 112, 114, 116. The base pipes 200 and connected packer assemblies 210', 210" are shown more fully in FIG. 2.

Figure 2:
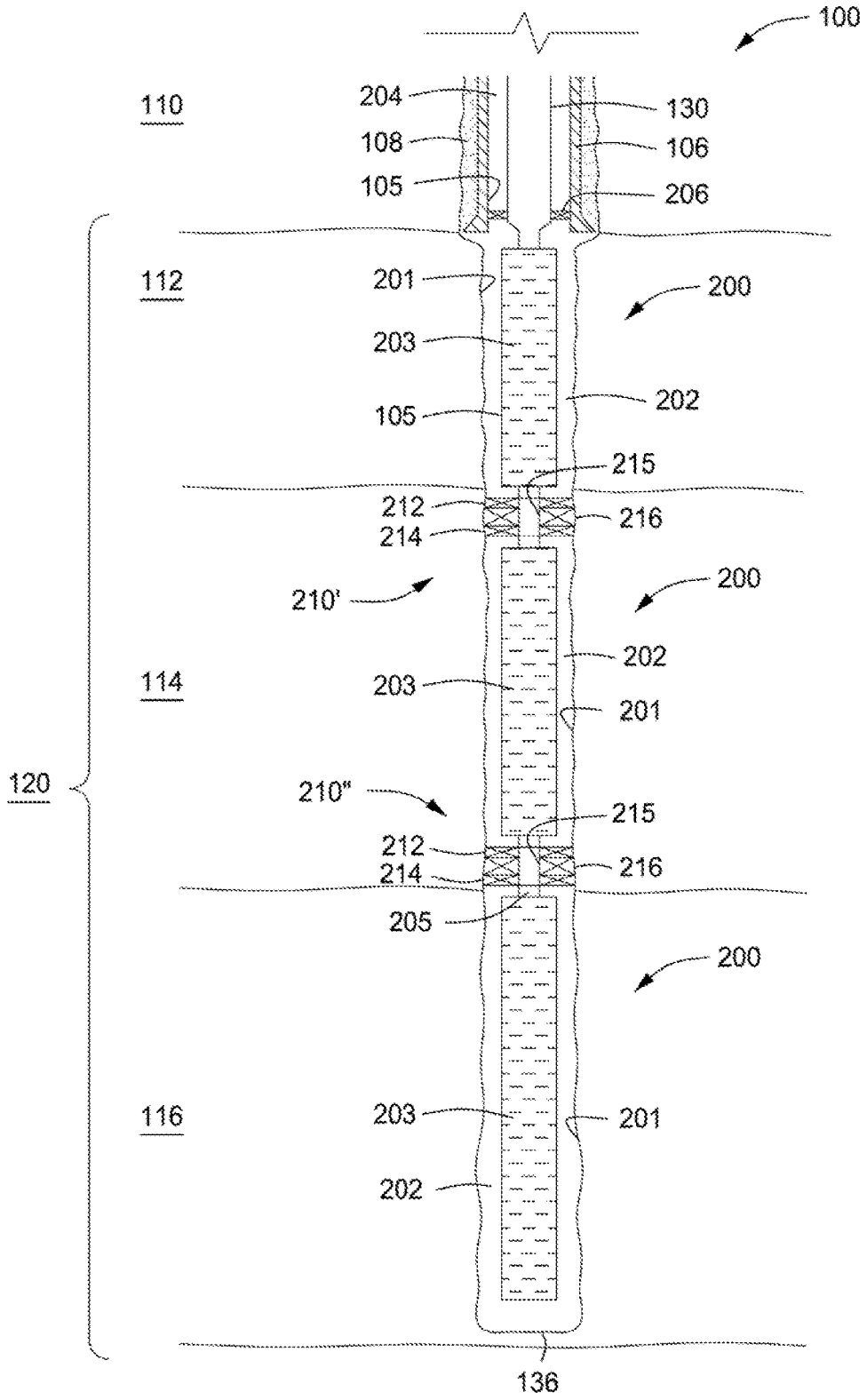
FIG. 2 is an enlarged cross-sectional view of an open-hole completion of the wellbore of FIG. 1. The open-hole completion at the depth of the three illustrative intervals is more clearly seen.

Referring now to FIG. 2, the base pipes 200 define an elongated tubular body 205. Each base pipe 205 typically is made up of a plurality of pipe joints. The base pipe 200 (or each pipe joint making up the base pipe 200) has perforations or slots 203 to permit the inflow of production fluids.

In another embodiment, the base pipes 200 are blank pipes having a filter medium (not shown) wound there around. In this instance, the base pipes 200 form sand screens. The filter medium may be a wire mesh screen or wire wrap fitted around the tubular bodies 205. Alternatively, the filtering medium of the sand screen may comprise a membrane screen, an expandable screen, a sintered metal screen, a porous media made of shape-memory polymer (such as that described in U.S. Pat. No. 7,926,565), a porous media packed with fibrous material, or a pre-packed solid particle bed. The filter medium prevents the inflow of sand or other particles above a pre-determined size into the base pipe 200 and the production tubing 130.

In addition to the base pipes 200, the wellbore 100 includes one or more packer assemblies 210. In the illustrative arrangement of FIGS. 1 and 2, the wellbore 100 has an upper packer assembly 210' and a lower packer assembly 210". However, additional packer assemblies 210 or just one packer assembly 210 may be used. The packer assemblies 210', 210" are uniquely configured to seal an annular region (seen at 202 of FIG. 2) between the various sand control devices 200 and a surrounding wall 201 of the open-hole portion 120 of the wellbore 100.

FIG. 2 provides an enlarged cross-sectional view of the open-hole portion 120 of the wellbore 100 of FIG. 1. The open-hole portion 120 and the three intervals 112, 114, 116 are more clearly seen. The upper 210' and lower 210" packer assemblies are also more clearly visible proximate upper and lower boundaries of the intermediate interval 114, respectively.

Concerning the packer assemblies themselves, each packer assembly 210', 210" may have two separate packers. The packers are preferably set through a combination of mechanical manipulation and hydraulic forces. For purposes of this disclosure, the packers are referred to as being mechanically-set packers. The illustrative packer assemblies 210 represent an upper packer 212 and a lower packer 214. Each packer 212, 214 has an expandable portion or element fabricated from an elastomeric or a thermoplastic material capable of providing at least a temporary fluid seal against a surrounding wellbore wall 201.

The elements for the upper 212 and lower 214 packers should be able to withstand the pressures and loads associated with a production process. The elements for the packers 212, 214 should also withstand pressure load due to differential wellbore and/or reservoir pressures caused by natural faults, depletion, production, or injection. Production operations may involve selective production or production allocation to meet regulatory requirements. Injection operations may involve selective fluid injection for strategic reservoir pressure maintenance. Injection operations may also involve selective stimulation in acid fracturing, matrix acidizing, or formation damage removal.

The sealing surface or elements for the mechanically-set packers 212, 214 need only be on the order of inches in order to affect a suitable hydraulic seal. In one aspect, the elements are each about 6 inches (15.2 cm) to about 24 inches (61.0 cm) in length.

It is preferred for the elements of the packers 212, 214 to be able to expand to at least an 11-inch (about 28 cm) outer diameter surface, with no more than a 1.1 ovality ratio. The elements of the packers 212, 214 should preferably be able to handle washouts in an 8½ inch (about 21.6 cm) or 9⅞ inch (about 25.1 cm) open-hole section 120. The expandable portions of the packers 212, 214 will assist in maintaining at least a temporary seal against the wall 201 of the intermediate interval 114 (or other interval) as pressure increases during the gravel packing operation.

The upper 212 and lower 214 packers are set prior to production. The packers 212, 214 may be set, for example, by sliding a release sleeve. This, in turn, allows hydrostatic pressure to act downwardly against a piston mandrel. The piston mandrel acts down upon a centralizer and/or packer elements, causing the same to expand against the wellbore wall 201. The elements of the upper 212 and lower 214 packers are expanded into contact with the surrounding wall 201 so as to straddle the annular region 202 at a selected depth along the open-hole completion 120. PCT Patent Appl. No. WO2012/082303 describes a packer that may be mechanically set within an open-hole wellbore.

FIG. 2 shows a mandrel at 215 in the packers 212, 214. This may be representative of the piston mandrel, and other mandrels used in the packers 212, 214 as described more fully in the PCT application.

As a "back-up" to the expandable packer elements within the upper 212 and lower 214 packers, the packer assemblies 210', 210" also may include an intermediate packer element 216. The intermediate packer element 216 defines a swelling elastomeric material fabricated from synthetic rubber compounds. Suitable examples of swellable materials may be found in Easy Well Solutions' Constrictor™ or Swell-Packer™, and SwellFix's E-ZIP™ The swellable packer 216 may include a swellable polymer or swellable polymer material, which is known by those skilled in the art and which may be set by one of a conditioned drilling fluid, a completion fluid, a production fluid, an injection fluid, a stimulation fluid, or any combination thereof.

It is noted that a swellable packer 216 may be used in lieu of the upper 212 and lower 214 packers. The present inventions are not limited by the presence or design of any packer assembly unless expressly so stated in the claims.

The upper 212 and lower 214 packers may generally be mirror images of each other, except for the release sleeves that shear respective shear pins or other engagement mechanisms. Unilateral movement of a setting tool (not shown) will allow the packers 212, 214 to be activated in sequence or simultaneously. The lower packer 214 is activated first, followed by the upper packer 212 as the shifting tool is pulled upward through an inner mandrel.

The packer assemblies 210', 210" help control and manage fluids produced from different zones. In this respect, the packer assemblies 210', 210" allow the operator to seal off an interval from either production or injection, depending on well function. Installation of the packer assemblies 210', 210" in the initial completion allows an operator to shut-off the production from one or more zones during the well lifetime to limit the production of water or, in some instances, an undesirable non-condensable fluid such as hydrogen sulfide.

Figure 3A:
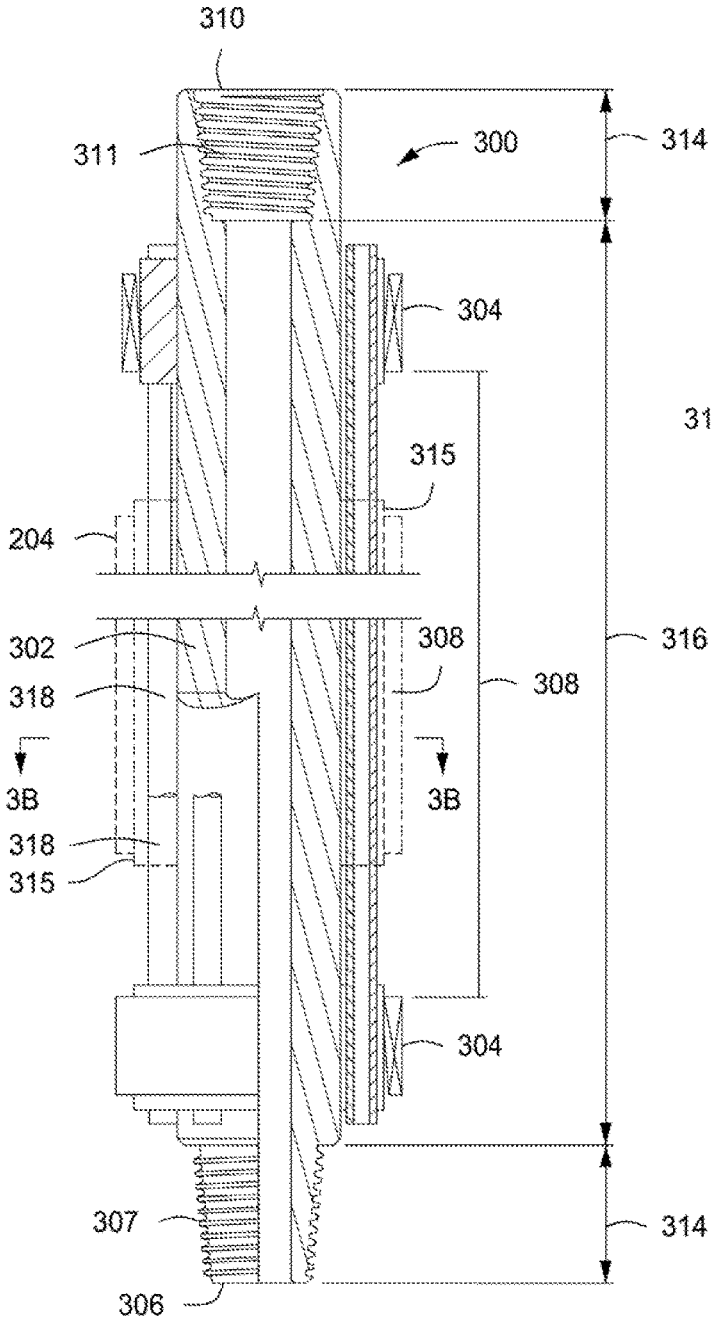
FIG. 3A is a cross-sectional side view of a packer assembly, in one embodiment. Here, a base pipe is shown, with surrounding packer elements. Two mechanically-set packers are shown.

FIG. 3A presents an illustrative packer assembly 300 providing an alternate flowpath for a gravel slurry or other injection fluid. The packer assembly 300 is generally seen in cross-sectional side view. The packer assembly 300 includes various components that may be utilized to seal an annulus along the open-hole portion 120.

The packer assembly 300 first includes a main body section 302. The main body section 302 is preferably fabricated from steel or from steel alloys. The main body section 302 is configured to be a specific length 316, such as about 40 feet (12.2 meters). The main body section 302 comprises individual pipe joints that will have a length that is between about 10 feet (3.0 meters) and 50 feet (15.2 meters). The pipe joints are typically threadedly connected end-to-end to form the main body section 302 according to length 316.

The packer assembly 300 also includes opposing mechanically-set packers 304. The mechanically-set packers 304 are shown schematically, and are generally in accordance with mechanically-set packer elements 212 and 214 of FIG. 2. The packers 304 preferably include cup-type elastomeric elements that are less than 1 foot (0.3 meters) in length. As described further below, the packers 304 have alternate flow channels that uniquely allow the packers 304 to be set before a gravel slurry is circulated into the wellbore.

The packer assembly 300 also optionally includes a swellable packer. Alternatively, a short spacing 308 may be provided between the mechanically-set packers 304 in lieu of the swellable packer. When the packers 304 are mirror images of one another, the cup-type elements are able to resist fluid pressure from either above or below the packer assembly.

The packer assembly 300 also includes a plurality of shunt tubes 318. The shunt tubes 318 may also be referred to as transport tubes or alternate flow channels or even jumper tubes. The transport tubes 318 are blank sections of pipe having a length that extends along the length 316 of the mechanically-set packers 304 and the swellable packer 308. This enables the shunt tubes 318 to transport a fluid to different intervals 112, 114 and 116 of the open-hole portion 120 of the wellbore 100.

The packer assembly 300 also includes connection members. These may represent traditional threaded couplings. First, a neck section 306 is provided at a first end of the packer assembly 300. The neck section 306 has external threads for connecting with a threaded coupling box of a sand screen or other pipe. Then, a notched or externally threaded section 310 is provided at an opposing second end. The threaded section 310 serves as a coupling box for receiving an external threaded end of a base pipe. The base pipe may be a perforated pipe; alternatively, the base pipe may be a blank tubular body for a sand screen.

The neck section 306 and the threaded section 310 may be made of steel or steel alloys. The neck section 306 and the threaded section 310 are each configured to be a specific length 314, such as 4 inches (10.2 cm) to 4 feet (1.2 meters) (or other suitable distance). The neck section 306 and the threaded section 310 also have specific inner and outer diameters. The neck section 306 has external threads 307, while the threaded section 310 has internal threads 311. These threads 307 and 311 may be utilized to form a seal between the packer assembly 300 and sand control devices or other pipe segments.

Figure 3B:
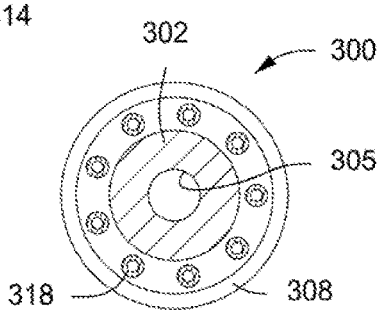
FIG. 3B is a cross-sectional view of the packer assembly of FIG. 3A, taken across lines 3B-3B of FIG. 3A. Shunt tubes are seen within the swellable packer element.

A cross-sectional view of the packer assembly 300 is shown in FIG. 3B. FIG. 3B is taken along the line 3B-3B of FIG. 3A. In FIG. 3B, the swellable packer 308 is seen circumferentially disposed around the base pipe 302. Various shunt tubes 318 are placed radially and equidistantly around the base pipe 302. A central bore 305 is shown within the base pipe 302. The central bore 305 receives production fluids during production operations and conveys them to the production tubing 130.

Figure 4A:
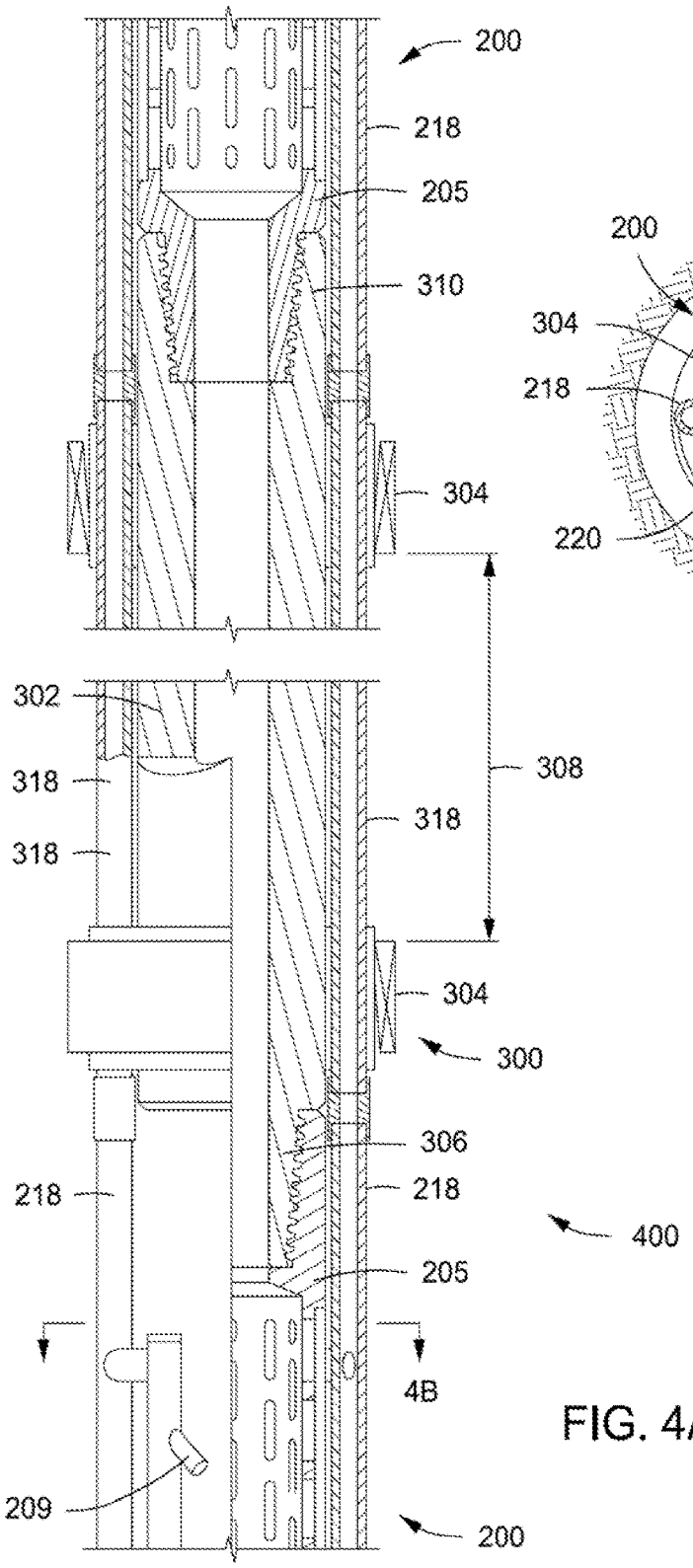
FIG. 4A is a cross-sectional side view of the packer assembly of FIG. 3A. Here, perforated base pipes have been placed at opposing ends of the packer assembly. The base pipes utilize external shunt tubes.

FIG. 4A presents a cross-sectional side view of a zonal isolation apparatus 400, in one embodiment. The zonal isolation apparatus 400 includes the packer assembly 300 from FIG. 3A. In addition, perforated base pipes 200 have been placed at opposing ends of the packer assembly 300. The base pipes 200 utilize external shunt tubes. Transport tubes 318 from the packer assembly 300 are seen connected to transport conduits 218 on the base pipes 200.

Figure 4B:
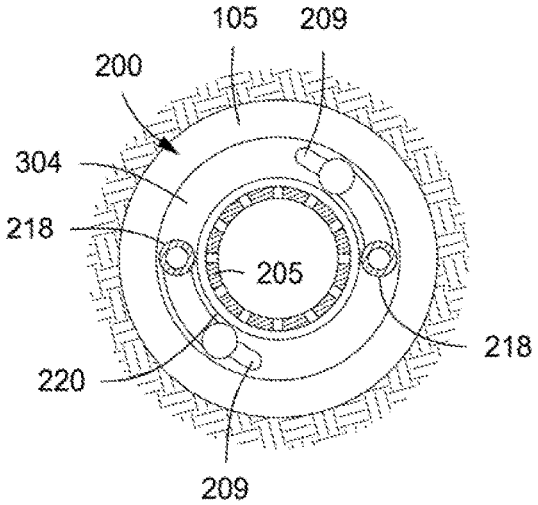
FIG. 4B provides a cross-sectional view of the screen assembly in FIG. 4A, taken across lines 4B-4B of FIG. 4A. Shunt tubes are seen outside of the base pipes to provide an alternative flowpath for a particulate slurry.

FIG. 4B provides a cross-sectional side view of the zonal isolation apparatus 400. FIG. 4B is taken along the line 4B-4B of FIG. 4A. This is cut through one of the sand screens 200. In FIG. 4B, the slotted or perforated base pipe 205 is seen. This is in accordance with base pipe 205 of FIGS. 1 and 2. The central bore 105 is shown within the base pipe 205 for receiving production fluids during production operations.

The configuration of the transport conduits 218 is preferably concentric. This is seen in the cross-sectional views of FIGS. 3B and 4B. However, the conduits 218 may be eccentrically designed. For example, FIG. 2B in U.S. Pat. No. 7,661,476 presents a "Prior Art" arrangement for a sand control device wherein packing tubes 208*a* and transport tubes 208*b* are placed external to the base pipe 202 and surrounding filter medium 204, forming an eccentric arrangement.

The packers 304 of FIG. 3A are shown schematically. However, FIGS. 5A and 5B provide more detailed views of a suitable mechanically-set packer 500 that may be used in the packer assembly of FIG. 3A, in one embodiment.

Figure 5A:
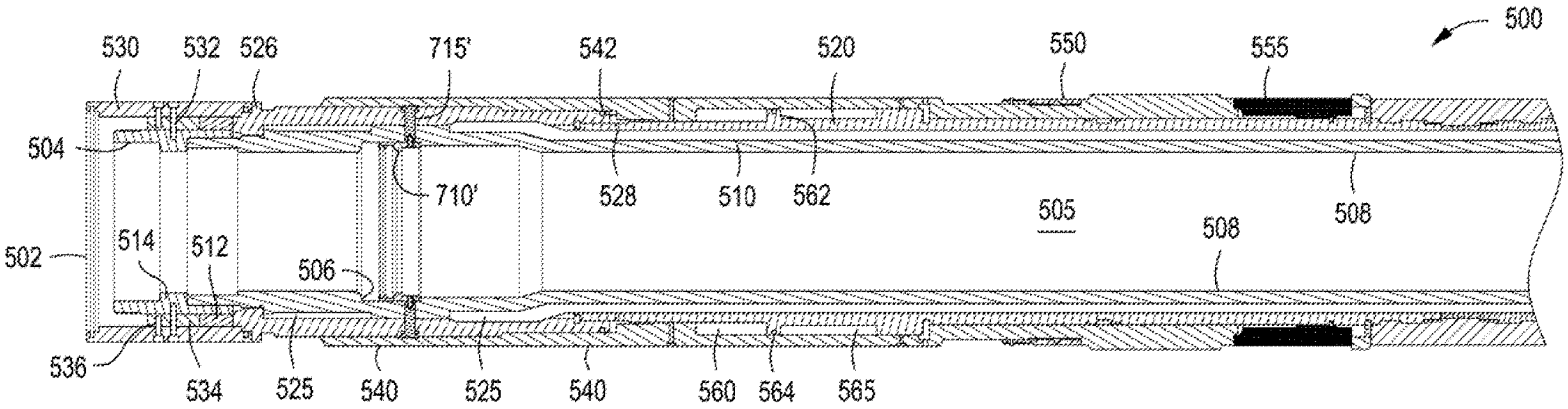
FIG. 5A is a cross-sectional view of one of the mechanically-set packers of FIG. 3A. Here, the mechanically-set packer is in its run-in position.
Figure 5B:
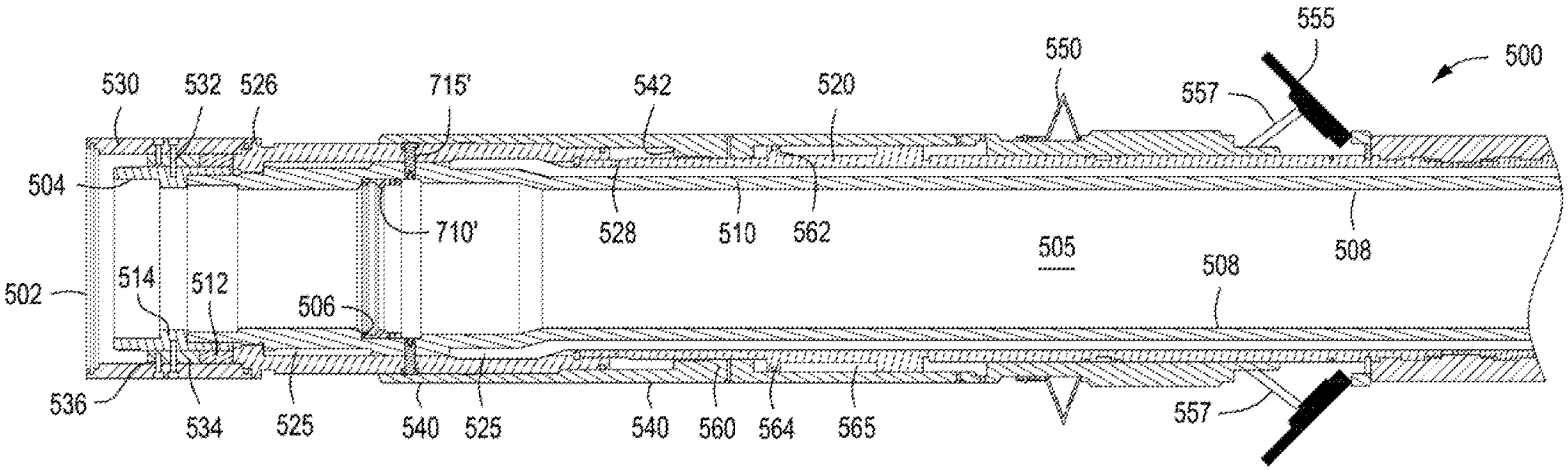
FIG. 5B is a cross-sectional view of the mechanically-set packers of FIG. 5A. Here, the mechanically-set packer has been activated and is in its set position.

The views of FIGS. 5A and 5B provide cross-sectional views. In FIG. 5A, the packer 500 is in its run-in position, while in FIG. 5B the packer 500 is in its set position.

The packer 500 first includes an inner mandrel 510. The inner mandrel 510 defines an elongated tubular body forming a central bore 505. The central bore 505 provides a primary flow path of production fluids through the packer 500. After installation and commencement of production, the central bore 505 transports production fluids to the bore 105 of the base pipes 200 (seen in FIG. 2) and the production tubing 130 (seen in FIGS. 1 and 2).

The packer 500 also includes a first end 502. Threads 504 are placed along the inner mandrel 510 at the first end 502. The illustrative threads 504 are external threads. A box connector 514 having internal threads at both ends is connected or threaded on threads 504 at the first end 502. The first end 502 of inner mandrel 510 with the box connector 514 is called the box end. The second end (not shown) of the inner mandrel 510 has external threads and is called the pin end. The pin end (not shown) of the inner mandrel 510 allows the packer 500 to be connected to the box end of a sand screen or other tubular body such as a stand-alone screen, a sensing module, a production tubing, or a blank pipe.

The box connector 514 at the box end 502 allows the packer 500 to be connected to the pin end of a sand screen or other tubular body such as a perforated base pipe 200.

The inner mandrel 510 extends along the length of the packer 500. The inner mandrel 510 may be composed of multiple connected segments, or joints. The inner mandrel 510 has a slightly smaller inner diameter near the first end 502. This is due to a setting shoulder 506 machined into the inner mandrel. The setting shoulder 506 catches a release sleeve (not shown) in response to mechanical force applied by a setting tool.

The packer 500 also includes a piston mandrel 520. The piston mandrel 520 extends generally from the first end 502 of the packer 500. The piston mandrel 520 may be composed of multiple connected segments, or joints. The piston mandrel 520 defines an elongated tubular body that resides circumferentially around and substantially concentric to the inner mandrel 510. An annulus 525 is formed between the inner mandrel 510 and the surrounding piston mandrel 520. The annulus 525 beneficially provides a secondary flow path or alternate flow channels for fluids.

The packer 500 also includes a coupling 530. The coupling 530 is connected and sealed (e.g., via elastomeric "o" rings) to the piston mandrel 520 at the first end 502. The coupling 530 is then threaded and pinned to the box connector 514, which is threadedly connected to the inner mandrel 510 to prevent relative rotational movement between the inner mandrel 510 and the coupling 530. A first torque bolt is shown at 532 for pinning the coupling to the box connector 514.

In one aspect, a NACA (National Advisory Committee for Aeronautics) key 534 is also employed. The NACA key 534 is placed internal to the coupling 530, and external to a threaded box connector 514. A first torque bolt is provided at 532, connecting the coupling 530 to the NACA key 534 and then to the box connector 514. A second torque bolt is provided at 536 connecting the coupling 530 to the NACA key 534. NACA-shaped keys can (a) fasten the coupling 530 to the inner mandrel 510 via box connector 514, (b) prevent the coupling 530 from rotating around the inner mandrel 510, and (c) streamline the flow of slurry along the annulus 512 to reduce friction.

Within the packer 500, the annulus 525 around the inner mandrel 510 is isolated from the main bore 505. In addition, the annulus 525 is isolated from a surrounding wellbore annulus (not shown). The annulus 525 enables the transfer of gravel slurry or other fluid from alternative flow channels (such as transport conduits 218) through the packer 500. Thus, the annulus 525 becomes the alternative flow channel(s) for the packer 500.

In operation, an annular space 512 resides at the first end 502 of the packer 500. The annular space 512 is disposed between the box connector 514 and the coupling 530. The annular space 512 receives slurry from alternate flow channels of a connected tubular body, and delivers the slurry to the annulus 525. The tubular body may be, for example, an adjacent sand screen, a blank pipe, or a zonal isolation device.

The packer 500 also includes a load shoulder 526. The load shoulder 526 is placed near the end of the piston mandrel 520 where the coupling 530 is connected and sealed. A solid section at the end of the piston mandrel 520 has an inner diameter and an outer diameter. The load shoulder 526 is placed along the outer diameter. The inner diameter has threads and is threadedly connected to the inner mandrel 510. At least one alternate flow channel is formed between the inner and outer diameters to connect flow between the annular space 512 and the annulus 525.

The load shoulder 526 provides a load-bearing point. During rig operations, a load collar or harness (not shown) is placed around the load shoulder 526 to allow the packer 500 to be picked up and supported with conventional elevators. The load shoulder 526 is then temporarily used to support the weight of the packer 500 (and any connected completion devices such as sand screen joints already run into the well) when placed in the rotary floor of a rig. The load may then be transferred from the load shoulder 526 to a pipe thread connector such as box connector 514, then to the inner mandrel 510 or base pipe 205, which is pipe threaded to the box connector 514.

The packer 500 also includes a piston housing 540. The piston housing 540 resides around and is substantially concentric to the piston mandrel 520. The packer 500 is configured to cause the piston housing 540 to move axially along and relative to the piston mandrel 520. Specifically, the piston housing 540 is driven by the downhole hydrostatic pressure. The piston housing 540 may be composed of multiple connected segments, or joints.

The piston housing 540 is held in place along the piston mandrel 520 during run-in. The piston housing 540 is secured using a release sleeve and release key. Operation of the release sleeve and the release key is set forth in detail in U.S. Patent Publication No. 2012/0217010 and is incorporated herein by reference in its entirety.

Figure 7A:
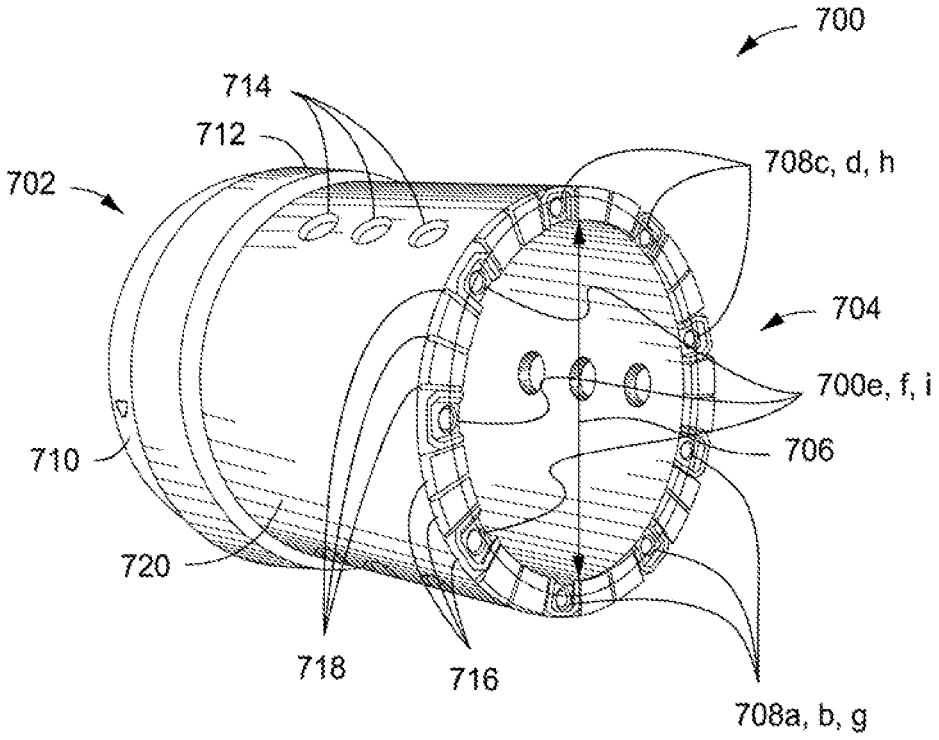
FIG. 7A is an isometric view of a load sleeve as utilized as part of the joint assembly of FIG. 6A, in one embodiment.
Figure 7B:
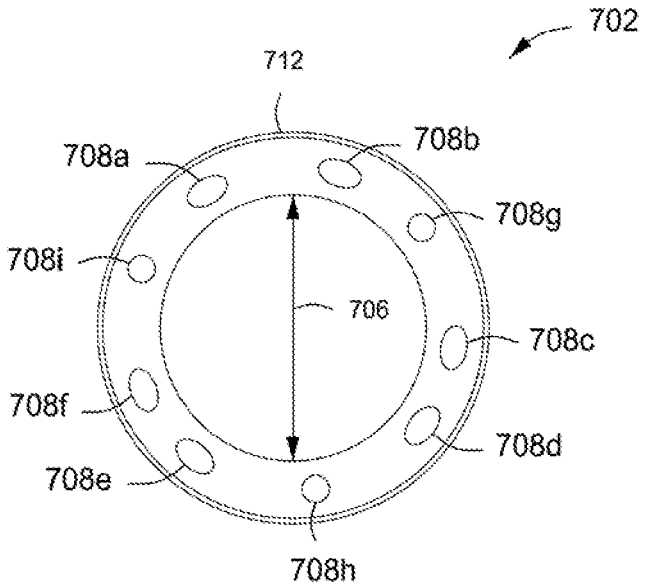
FIG. 7B is an end view of the load sleeve of FIG. 7A.

The release key is shown at 715. As shown in FIGS. 7A and 7B of the co-pending application, an outer edge of the release key 715 has a ruggled surface, or teeth. The teeth for the release key are shown at 736. The teeth of the release key are angled and configured to mate with a reciprocal niggled surface within the piston housing 540. The mating niggled surface (or teeth) for the piston housing 540 are shown at 546. The teeth reside on an inner face of the piston housing 540. When engaged, the teeth 736, 546 prevent movement of the piston housing 540 relative to the piston mandrel 520 or the inner mandrel 510.

The packer 500 also preferably includes a centralizing member 550. The centralizing member 550 is actuated by the movement of the piston housing 540. The centralizing member 550 may be, for example, as described in U.S. Patent Publication No. 2011/0042106.

The packer 500 further includes a sealing element 555. As the centralizing member 550 is actuated and centralizes the packer 500 within the surrounding wellbore, the piston housing 540 continues to actuate the sealing element 555 as described in U.S. Patent Publication No. 2009/0308592.

In FIG. 5A, the centralizing member 550 and sealing element 555 are in their run-in position. In FIG. 5B, the centralizing member 550 and connected sealing element 555 have been actuated. This means the piston housing 540 has moved along the piston mandrel 520, causing both the centralizing member 550 and the sealing element 555 to engage the surrounding wellbore wall.

As noted, movement of the piston housing 540 takes place in response to hydrostatic pressure from wellbore fluids, including the gravel slurry. In the run-in position of the packer 500 (shown in FIG. 5A), the piston housing 540 is held in place by the release sleeve 710 and associated piston key 715. Operation of the release sleeve and the release key is again set forth in detail in U.S. Patent Publication No. 2012/0217010, particularly in connection with FIGS. 7A and 7B therein.

To move the release the release sleeve, a setting tool is used. An illustrative setting tool is shown at 750 in FIG. 7C of the co-pending provisional patent application. Preferably, the setting tool is run into the wellbore with a washpipe string (not shown). Movement of the washpipe string along the wellbore can be controlled at the surface. Movement of the washpipe string causes a pin to be sheared, producing movement of the release sleeve, and thereby allowing the release key to disengage from the piston housing 540.

After the shear pins have been sheared, the piston housing 540 is free to slide along an outer surface of the piston mandrel 520. Hydrostatic pressure then acts upon the piston housing 540 to translate it downward relative to the piston mandrel 520. More specifically, hydrostatic pressure from the annulus 525 acts upon a shoulder 542 in the piston housing 540. This is seen best in FIG. 5B. The shoulder 542 serves as a pressure-bearing surface. A fluid port 528 is provided through the piston mandrel 520 to allow fluid to access the shoulder 542. The pressure is applied to the piston housing 540 to ensure that the packer elements 655 engage against the surrounding wellbore.

To further understand features of the illustrative mechanically-set packer 500, reference is again made to U.S. Patent Publication No. 2012/0217010. This co-pending application presents additional cross-sectional views, shown at FIGS. 6C, 6D, 6E, and 6F of this application. Descriptions of the cross-sectional views need not be repeated herein.

It is necessary to connect the packer 500 to the base pipes 200. It is further necessary to sections of base pipe joints together to form a base pipe 200. These operations may be done using a unique coupling assembly that employs a load sleeve, a torque sleeve, and an intermediate coupling joint.

Figure 6A:
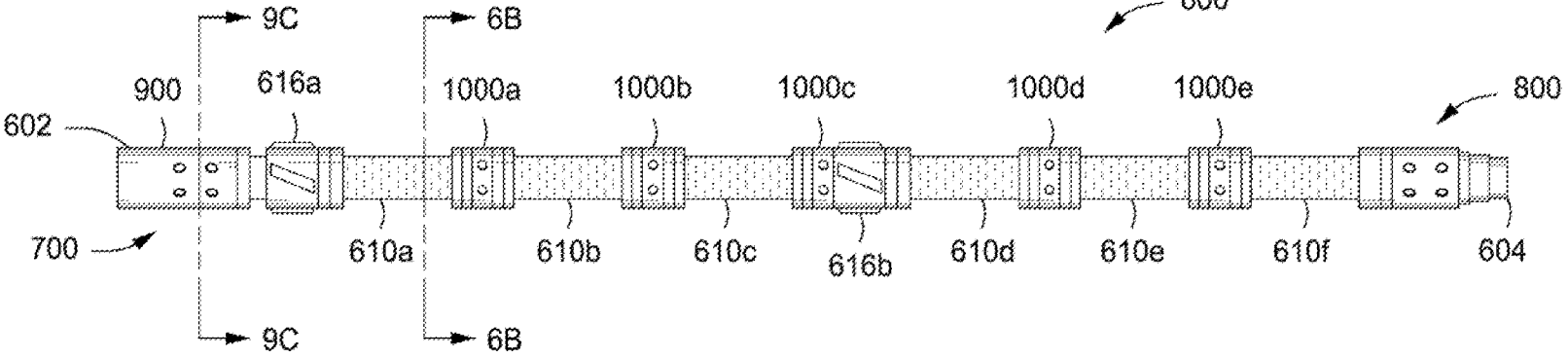
FIG. 6A is a side view of a wellbore completion apparatus as may be used in the joint assembly of the present invention, in one embodiment. The joint assembly includes a series of perforated base pipes connected using nozzle rings.

FIG. 6A offers a side view of a joint assembly 600 as may be used in the wellbore completion apparatus of the present invention, in one embodiment. The joint assembly 600 includes a plurality of base pipes 610*a*, 610*b*, . . . 610*f*. The base pipes 610*a*, 610*b*, . . . 610*f* are connected in series using nozzle rings 910*a*, 910*b*, . . . 910*n*. Preferably, the base pipes are slotted or perforated pipes.

Figure 6B:
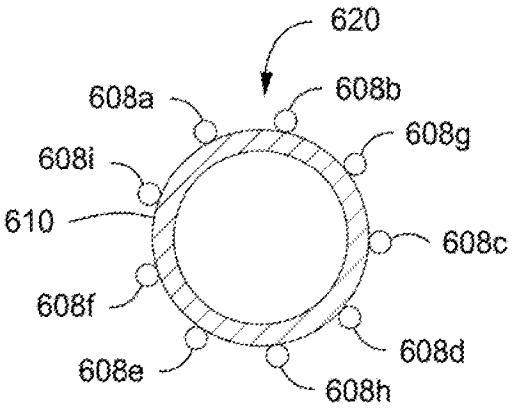
FIG. 6B is a cross-sectional view of the wellbore completion apparatus of FIG. 6A, taken across lines 6B-6B of FIG. 6A. This shows one of the joint assemblies.

FIG. 6B is a cross-sectional view of the joint assembly 600 of FIG. 6A, taken across line 6B-6B of FIG. 6A. Specifically, the view is taken through a base pipe 610*a*.

Referring back to FIG. 6A, the joint assembly 600 has a first or upstream end 602 and a second or downstream end 604. A load sleeve 700 is operably attached at or near the first end 602, while a torque sleeve 800 is operably attached at or near the second end 604. The sleeves 700, 800 are preferably manufactured from a material having sufficient strength to withstand the contact forces achieved during running operations. One preferred material is a high yield alloy material such as S165M.

FIG. 7A is an isometric view of a load sleeve 700 as utilized as part of the joint assembly of FIG. 6A, in one embodiment. FIG. 7B is an end view of the load sleeve 700 of FIG. 7A. As can be seen, the load sleeve 700 comprises an elongated body 720 of substantially cylindrical shape. The load sleeve 700 has an outer diameter and a bore extending from a first end 702 to a second end 704.

The load sleeve 700 includes at least two transport conduits 708*a*, 708*b*, . . . 708*f*. In the view of FIG. 6B, six separate transport conduits are shown. The transport conduits are disposed exterior to the inner diameter and interior to the outer diameter.

In some embodiments of the present techniques, the load sleeve 700 includes beveled edges 716 at the downstream end 704 for easier welding of the transport conduits 708*a*, 708*b*, . . . 708*i* thereto. The preferred embodiment also incorporates a plurality of radial slots or grooves 718 in the face of the downstream or second end 704.

Preferably, the load sleeve 700 includes radial holes 714 between its downstream end 704 and a load shoulder 712. The radial holes 714 are dimensioned to receive threaded connectors, or bolts, (not shown). The connectors provide a fixed orientation between the load sleeve 700 and the base pipe 610. For example, there may be nine holes 714 in three groups of three spaced substantially equally around the outer circumference of the load sleeve 700 to provide the most even distribution of weight transfer from the load sleeve 700 to the base pipe 610.

Figure 8:
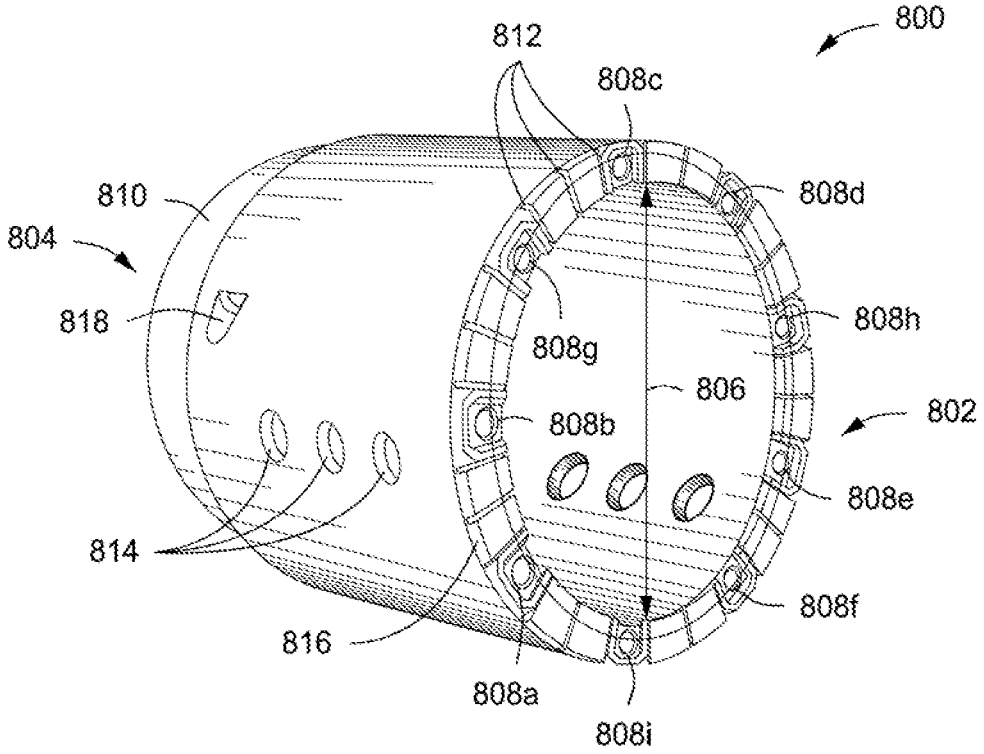
FIG. 8 is a perspective view of a torque sleeve as utilized as part of the joint assembly of FIG. 6A, in one embodiment.

Referring next to FIG. 8, FIG. 8 is a perspective view of a torque sleeve 800 utilized as part of the joint assembly 600 of FIG. 6A, in one embodiment. The torque sleeve 800 is positioned at the downstream or second end 604 of the illustrative assembly 600.

The torque sleeve 800 includes an upstream or first end 802 and a downstream or second end 804. The torque sleeve 800 also has an inner diameter 806. The torque sleeve 800 further has various alternate path channels, or transport conduits 808*a*-808*i*. The transport conduits 808*a*-808*f* extend from the first end 802 to the second end 804. In the event that the torque sleeve 800 is in fluid communication with a sand screen, the channels may also represent packing conduits 808*g*-808*i*. The packing conduits 808*g*-808*i* will terminate before reaching the second end 804 and release slurry through nozzles 818.

Preferably, the torque sleeve 800 includes radial holes 814 between the upstream end 802 and a lip portion 810 to accept threaded connectors, or bolts, therein. The connectors provide a fixed orientation between the torque sleeve 800 and the base pipe 610. For example, there may be nine holes 814 in three groups of three, spaced equally around the outer circumference of the torque sleeve 800. In the embodiment of FIG. 8, the torque sleeve 800 has beveled edges 816 at the upstream end 802 for easier attachment of the transport conduits 808 thereto.

The load sleeve 700 and the torque sleeve 800 enable immediate connections with packer assemblies or other elongated downhole tools while aligning transport conduits. It is desirable to mechanically connect the load sleeve 700 to the torque sleeve 800. This is done through an intermediate threaded coupling joint 900.

Figure 9A:
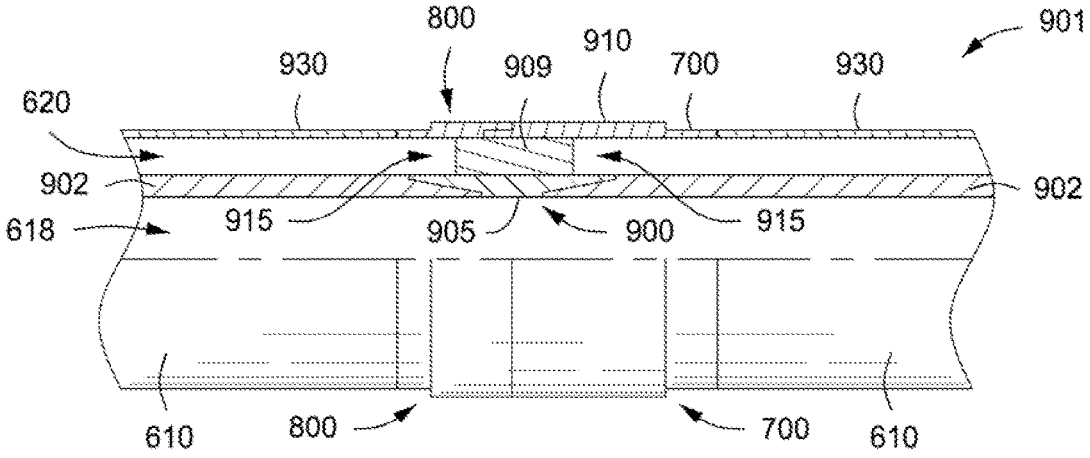
FIG. 9A is a side, cut-away view of a joint assembly of the present invention in one embodiment.

FIG. 9A presents a side view of a joint assembly 901 of the present invention in one embodiment. In FIG. 9A, the joint 901 includes a load sleeve 700 and a torque sleeve 800. The load sleeve 700 and the torque sleeve 800 are connected by means of a coupling joint 900.

Figure 9B:
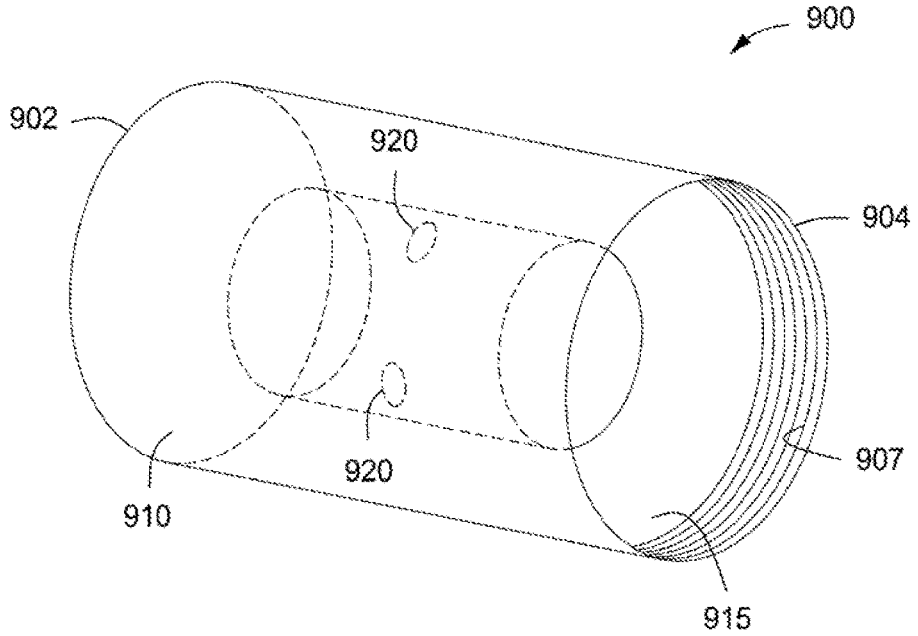
FIG. 9B is a perspective view of a coupling joint as may be used in the joint assembly of FIG. 6A.

FIG. 9B is a perspective view of the coupling joint 900 as may be used in the joint assembly 901 of FIG. 9A. The coupling joint 900 is a generally cylindrical body having an outer wall 910. The coupling joint 900 has a first end 902 and a second end 904. The first end 902 contains female threads (not shown) that threadedly connect to male threads of the torque sleeve 800. Similarly, the second end 904 contains female threads 907 that threadedly connect to male threads of the load sleeve 700.

In a more preferred arrangement, the outer wall 910 defines a co-axial sleeve. Opposing ends of the co-axial sleeve have respective shoulders that land on the load sleeve 700 and the torque sleeve 800.

Interior to the coupling joint 900 is a main body 905. The main body 905 defines a bore having opposing ends. The opposing ends threadedly connect to respective base pipes 610. An annular region is formed between an outer diameter of the main body 905 and an inner diameter of the outer wall 910 (the co-axial sleeve). This is referred to as a manifold 915.

Figure 9C:
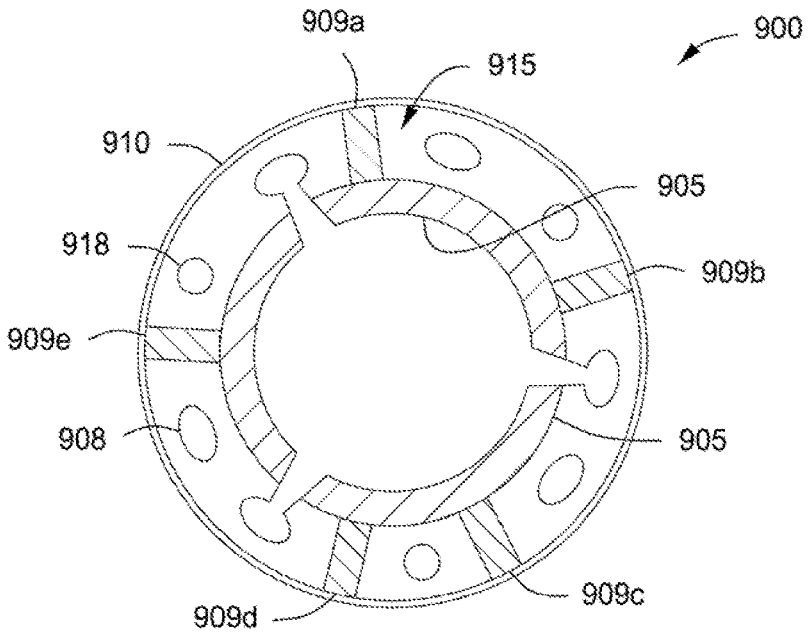
FIG. 9C is a cross-sectional view of the coupling joint of FIG. 6A, taken across line 9C-9C of FIG. 6A.

FIG. 9C is a cross-sectional view of the coupling joint 900 of FIG. 6A and FIG. 9B, taken across line 9C-9C of FIG. 6A. In FIG. 9C, the manifold 915 is more clearly seen. In the arrangement of FIG. 9C, the manifold 915 is not open, but is made up of separate transport conduits 908. Six transport conduits 908 are provided. The transport conduits 908 enable transport tubes 708*a*, 708*b*, . . . 708*f* in the load sleeve 700 and transport tubes 808*a*, 808*b*, . . . 808*f* in the torque sleeve 800 to be placed in fluid communication. The transport conduits 908 are part of a secondary flow path.

In FIG. 9C, optional packing conduits 918 are also provided. The packing conduits 918 are isolated from the transport conduits 908. The packing conduits 918 place any packing conduits in the load sleeve 700 with any packing conduits 808*g*-808*i* in the torque sleeve 800. The packing conduits 918 are only needed if the tool assembly 901 is used for gravel packing.

The coupling joint 900 offers a plurality of torque spacers 909*a*, 909*b*, . . . 909*e*. The torque spacers 909*a*, 909*b*, . . . 909*e* support the annular region 915 between the main body 905 and the surrounding co-axial sleeve 910. Stated another way, the torque spacers 909*a*, 909*b*, . . . 909*e* provide structural integrity to the co-axial sleeve 910 to provide a substantially concentric alignment with the main body 905. Additionally, the torque spacers 909*a*, 909*b*, . . . 909*e* may be configured to prevent tortuous fluid flow.

In the present invention, the coupling joint 900 further includes one or more flow ports 920. These are seen in both FIGS. 9B and 9C. The flow ports 920 provide fluid communication between the inner bore defined by the main body 905 and at least two of the transport conduits 908. In the view of FIG. 9C, three separate flow ports 920 are provided.

Returning to FIG. 9A, FIG. 9A shows a primary flow path at 618 and a secondary flow path at 620. The primary flow path 618 represents a flow path through the bore of the base pipes 610*a*, 610*b*, . . . 610*f*, the bore of the load sleeve 700, the bore of the main body 905, and the bore of the torque sleeve 800. The secondary flow path 620, in turn, represents a flow path through the transport conduits 708*a*, 708*b*, . . . 708*f* of the load sleeve 700, the manifold 915 of the coupling joint and the transport conduits 808*a*, 808*b*, . . . 808*f* in the torque sleeve 800. Additionally, the secondary flow path includes transport conduits 930 external to the base pipes 610.

Returning to FIG. 6A, it can be seen that the illustrative joint assembly 600 includes a plurality of base pipes 610*a*, 610*b*, . . . 610*f*. The base pipes 610*a*, 610*b*, . . . 610*f* represent separate joints. In order to connect the joints together while maintaining alignment with the transport conduits 930, nozzle rings 1000 are used.

Figure 10:
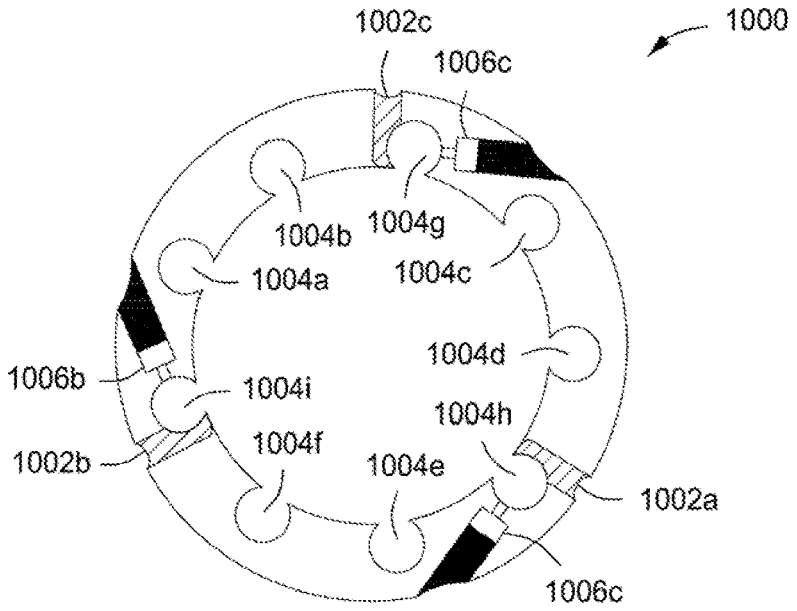
FIG. 10 is an end view of a nozzle ring utilized along the joint assembly of FIG. 6A.

FIG. 10 is an end view of a nozzle ring 1000 utilized as part of the joint assembly 600 of FIG. 6A. The nozzle ring 1000 is adapted and configured to fit around the base pipe 610*a*, 610*b*, . . . 610*e*, the transport conduits 930 and, if used, packing conduits. The nozzle ring 1000 is shown in the side view of FIG. 9A as nozzle rings 1010*a*, 1010*b*, . . . 1010*n*. Each nozzle ring 1000 is held in place by wire-wrap welds at the grooves similar to item 812 in FIG. 8. Split rings (not shown) may be installed at the interface between each nozzle ring 1000 and the wire-wrap.

The nozzle ring 1000 includes a plurality of channels 1004*a*, 1004*b*, . . . 1004*i* to accept the transport tubes 930 and, optionally, packing tubes 608*g*, 608*h*, 608*i*. Each channel 1004*a*, 1004*b*, . . . 1004*i* extends through the nozzle ring 1000 from an upstream or first end to a downstream or second end.

Additional details concerning the load sleeve 700, the torque sleeve 800, the coupling joint 900 and the nozzle ring 1000 are provided in U.S. Pat. No. 7,938,184. FIGS. 3A, 3B, 3C, 4A, 4B, 5A, 5B, 6 and 7 present details concerning components of a joint assembly in the context of using a sand screen. These figures and accompanying text are incorporated herein by reference.

Each base pipe 610*a*, 610*b*, . . . 610*f* has at least two transport conduits (visible at 930 in FIG. 9A). The transport conduits 930 deliver fluid into an annular region defined by an outer diameter of the base pipes 610*a*, 610*b*, . . . 610*e* and the surrounding open-hole formation in a wellbore.

Figure 11A:
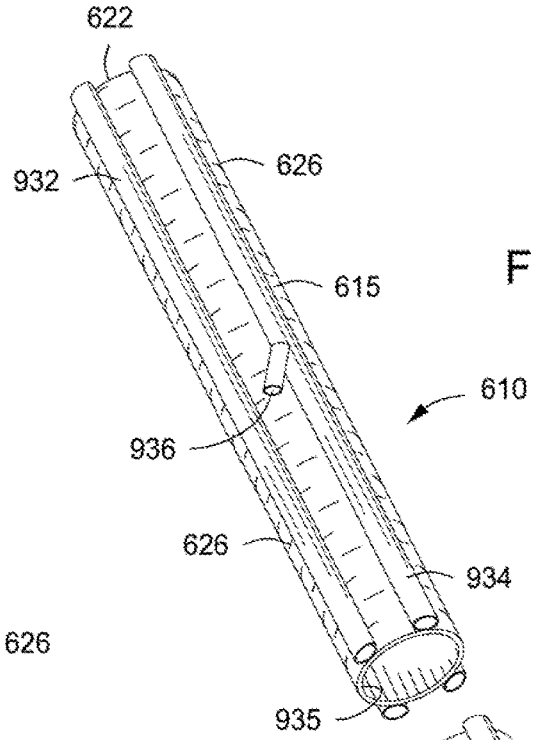
FIGS. 11A and 11B are perspective views of a base pipe as may be utilized in the joint assembly of the present invention, in alternate embodiments.
Figure 11B:
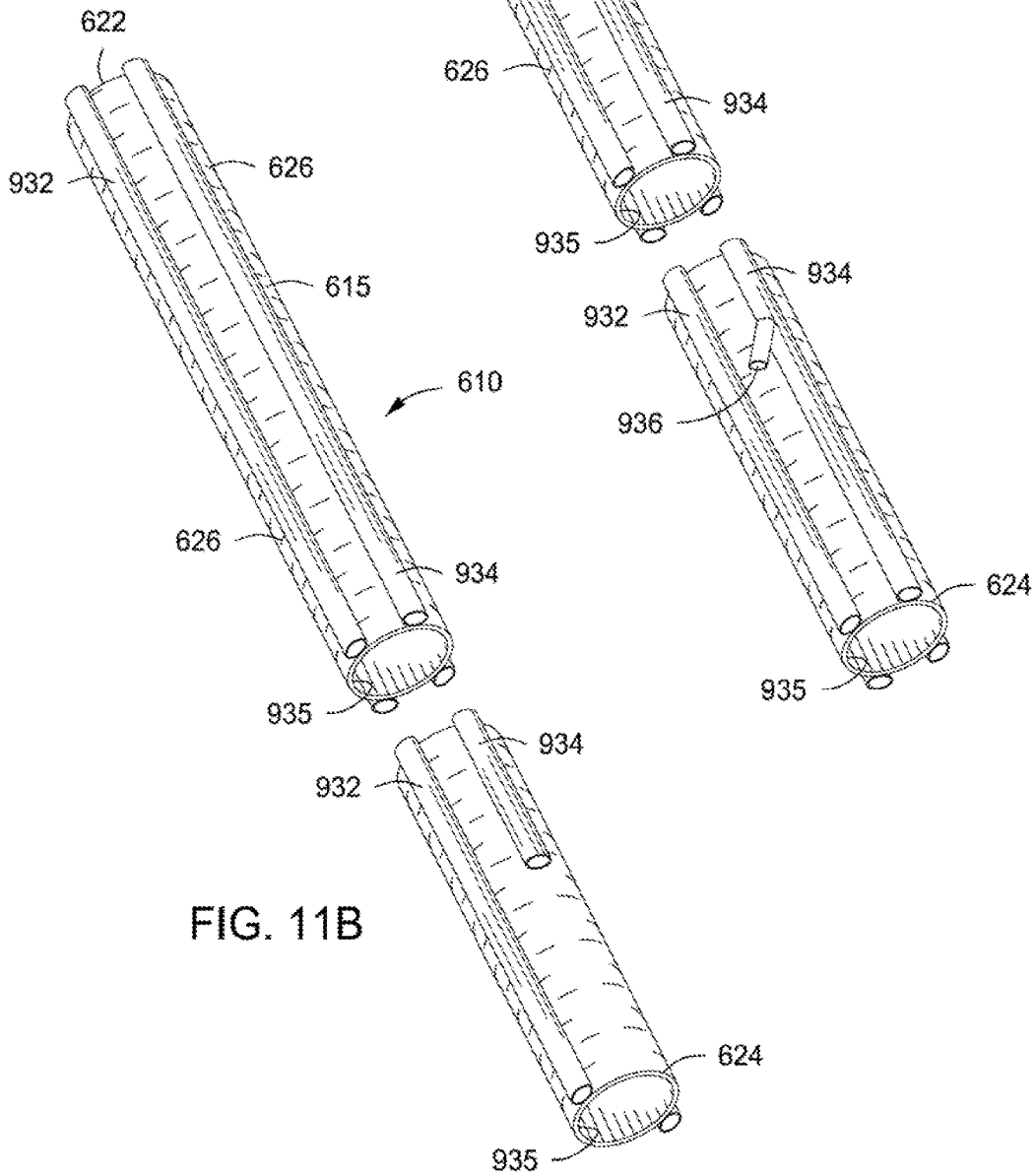

FIGS. 11A and 11B offer perspective cut-away views of a base pipe 610 as may be utilized in the joint assembly of the present invention, in alternate embodiments. The base pipe 610 provides an expanded view of the base pipes 610 shown in FIG. 6. The base pipe 610 is designed to be run into a wellbore and along an open-hole formation (not shown).

In each of FIGS. 11A and 11B, the base pipe 610 includes a tubular body 615. The tubular body 615 defines a bore 935 within an inner diameter. The bore 935 is part of the primary flow path offered for fluid flow herein. In one aspect, the base pipe 615 is between about 8 feet and 40 feet (2.4 meters to 12.2 meters) in length.

In the arrangement of FIGS. 11A and 11B, the base pipe 610 is a perforated pipe. A plurality of slots 626 is shown along the length of the base pipe 610. Slots 626 are comparable to slots 203 of FIG. 2.

Along an outer diameter of the tubular body 615 is a plurality of conduits 932, 934. The conduits 932, 934 are transport conduits, and are part of the secondary flow path offered for fluid flow herein. The conduits 932, 934 are preferably constructed from steel, such as a lower yield, weldable steel.

The transport conduits 932, 934 are designed to carry a fluid. If the wellbore is formed for a producer, the fluid will be hydrocarbon fluids. Alternatively, the fluid may be a treatment fluid for conditioning the formation, such as an acid solution. If the wellbore is formed for injection, the fluid will be an aqueous fluid.

In FIG. 11A, four transport conduits 932, 934 are shown. However, it is understood that more than or fewer than four conduits 932, 934 may be employed, so long as there are at least two. In the arrangement of FIG. 11A, each of the transport conduits 932, 934 extends along the entire length of the tubular body 615. However, transport conduit 934 includes nozzle 936 along the tubular body 615 for delivering fluids into the annulus. Preferably, nozzles 936 are spaced at about six foot intervals.

In FIG. 11B, four transport conduits 932, 934 are again shown. However, in the arrangement of FIG. 11B at least one of the transport conduits 934 terminates along the length of the tubular body 615. In this instance, no nozzles are required for delivering fluids into the annulus.

As noted, the base pipe 610 is designed to be run into an open-hole portion of a wellbore. The base pipe 610 is ideally run in pre-connected joints using nozzle rings, such as the nozzle ring 1000 of FIG. 10. Sections of pre-connected joints are then connected at the rig using a coupling assembly, such as the assembly 901 of FIG. 9A. The coupling assembly will preferably include a load sleeve, such as the load sleeve 700 of FIGS. 7A and 7B, a torque sleeve, such as the torque sleeve 800 of FIG. 8, and an intermediate coupling joint, such as the coupling joint 900 of FIGS. 9A and 9B.

Figure 12A:
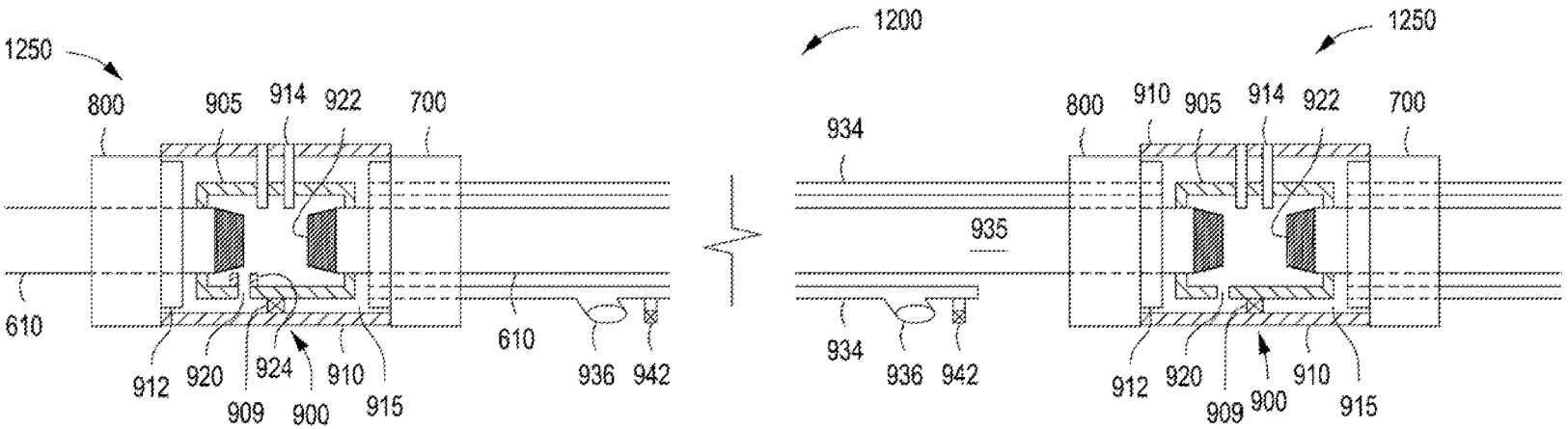
FIGS. 12A and 12B present side views of joint assemblies of the present invention, in alternate embodiments.
Figure 12B:
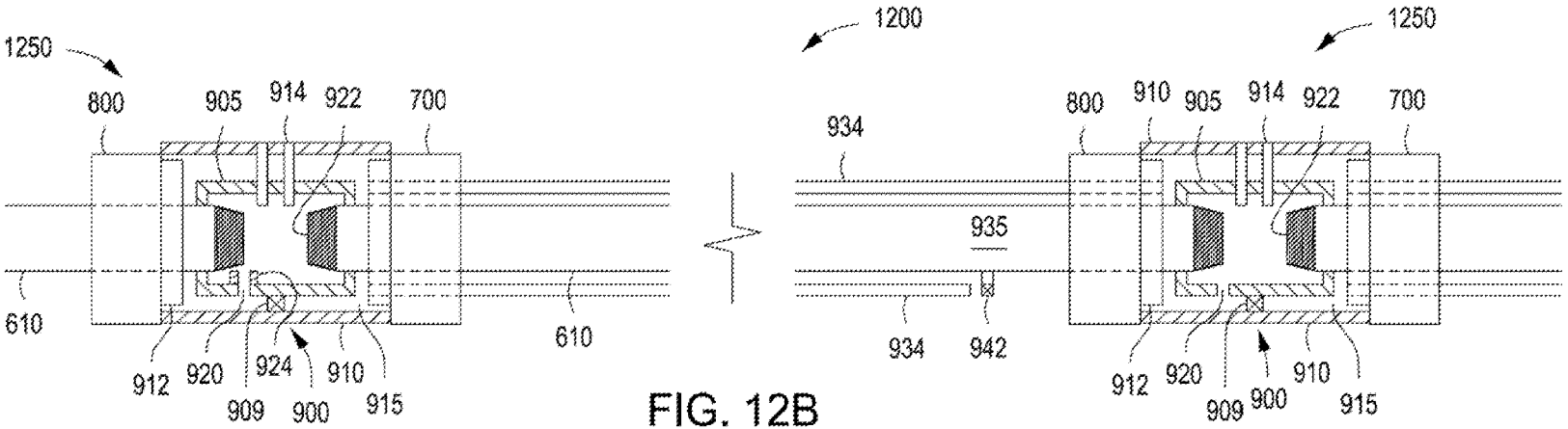

FIGS. 12A and 12B present side, cut-away views of a joint assembly 1200 of the present invention, in alternate embodiments. In each of FIGS. 12A and 12B, a base pipe 610 is seen. The base pipe 610 includes transport conduits 932, 934 in accordance with base pipe 610 of FIGS. 11A and 11B described above. The base pipe 610 may actually be several joints of base pipe threadedly connected in series using nozzle rings.

At opposing ends of the base pipe 610 are coupling assemblies 1250. Each of the coupling assemblies 1250 is configured to have a coupling joint 900. The coupling joint 900 includes a main body 905 and a surrounding co-axial sleeve 910 in accordance with FIG. 9B. Additionally, the coupling joint 900 includes a manifold region 915 and at least one flow port 920 in accordance with FIG. 9C.

Additional features of the coupling joint 900 include a torque spacer 909 and optional bolts 914. The torque spacer 909 and bolts 914 hold the main body 905 in fixed concentric relation relative to the co-axial sleeve 910. Also, an inflow control device 924 is shown. The inflow control device 924 allows the operator to selectively open, partially open, close or partially close a valve associated with the flow port 920. This may be done, for example, by sending a tool downhole on a wireline or an electric line or on coiled tubing that has generates a wireless signal. The signal may be, for example, a Bluetooth signal or an Infrared (IR) signal. The inflow control device 924 may be, for example, a sliding sleeve or a valve. In one aspect, the flow port is an inflow control device.

The coupling assemblies 1250 also each have a torque sleeve 800 and a load sleeve 700. The torque sleeve 800 and the load sleeve 700 enable connections with the base pipe 610 while aligning shunt tubes. U.S. Pat. No. 7,661,476 discloses a production string (referred to as a joint assembly) that employs a series of sand screen joints. The sand screen joints are placed between a "load sleeve" and a "torque sleeve." The '476 patent is incorporated by reference herein in its entirety.

In FIG. 12A, the transport conduit 934 has a shortened length. At the end of the shortened transport conduit is a valve 942. The valve 942 allows an operator to selectively open and close the end of the transport conduit 934 to fluid flow. This again may be done by sending a tool downhole on a wireline or an electric line or on coiled tubing that has generates a wireless signal.

In FIG. 12B, the transport conduit 934 has a full length, but includes nozzles 936. Associate with the respective nozzles are valves 942. The valves 942 allow for selective opening and closing of the transport conduit 934 to fluid flow.

Figure 13A:
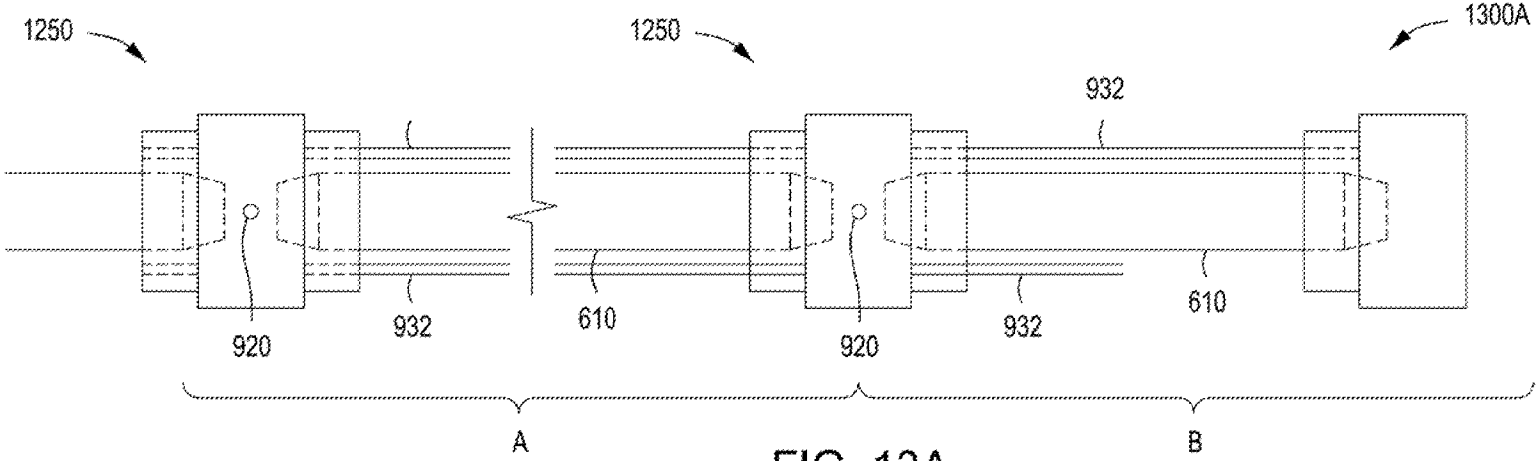
FIGS. 13A and 13B present side views of joint assemblies of the present invention, in additional alternate embodiments.
Figure 13B:
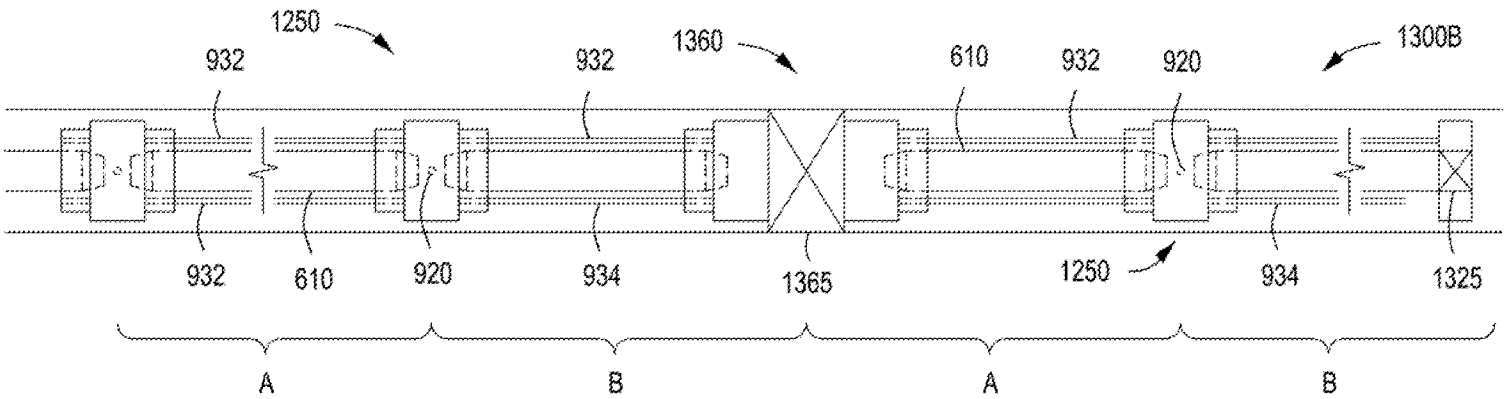

FIGS. 13A and 13B present side views of a joint assembly 1300A, 1300B of the present invention, in alternate embodiments. In each of FIGS. 13A and 13B, base pipes 610 are shown in series. The base pipes 610 may be individual base pipes, or may be joints of base pipe connected in series through nozzle rings, such as the ring 1000 of FIG. 10. In either event, the base pipes 610 are connected in a wellbore using coupling assemblies 1250.

The coupling assemblies 1250 may be in accordance with the views shown in FIGS. 9A, 12A and 12B. In this respect, the couplings assemblies will include a torque sleeve 800, a load sleeve 700, and an intermediate coupling joint 900. Of interest, the coupling joint 900 will include one or more flow ports 920 that place a primary flow path provided through the base pipes 610 in fluid communication with a secondary flow path provided through the transport conduits 932, 934.

In the joint assembly 1300A of FIG. 13A, separate assembly portions "A" and "B" are shown. In portion "A", only transport conduits 932 are provided. Thus, there is no fluid communication between the primary flow path and the wellbore annulus in which the transport conduits 932 reside. In portion "B", transport conduits 932 and 934 are shown. Transport conduit 934 provides fluid communication between the primary flow path and the wellbore annulus. Thus, a fixed degree of flow control is provided.

In the joint assembly 1300B of FIG. 13B, separate assembly portions "A" and "B" are again shown. Indeed, two separate pairs of portions "A" and "B" are provided. Of interest, a packer assembly 1360 is seen along the joint assembly 1300B. In the illustrative assembly of FIG. 13A, the packer assembly employs a swellable packer element 1365. However, a mechanically-set packer, such as packer 500 shown in FIG. 5, may alternatively be used. The packer assembly 1360 is used to isolate zones above and below the sealing element 1365.

Also of interest, an optional plug 1325 is seen in the joint assembly 1300B. The plug 1325 is placed in the bore of the base pipe 610. This isolates the portions "A" and "B" from any formations below the assembly 1300B. For example, the plug may isolate section 116 of the open hole portion 120 of FIG. 2.

Figure 14:
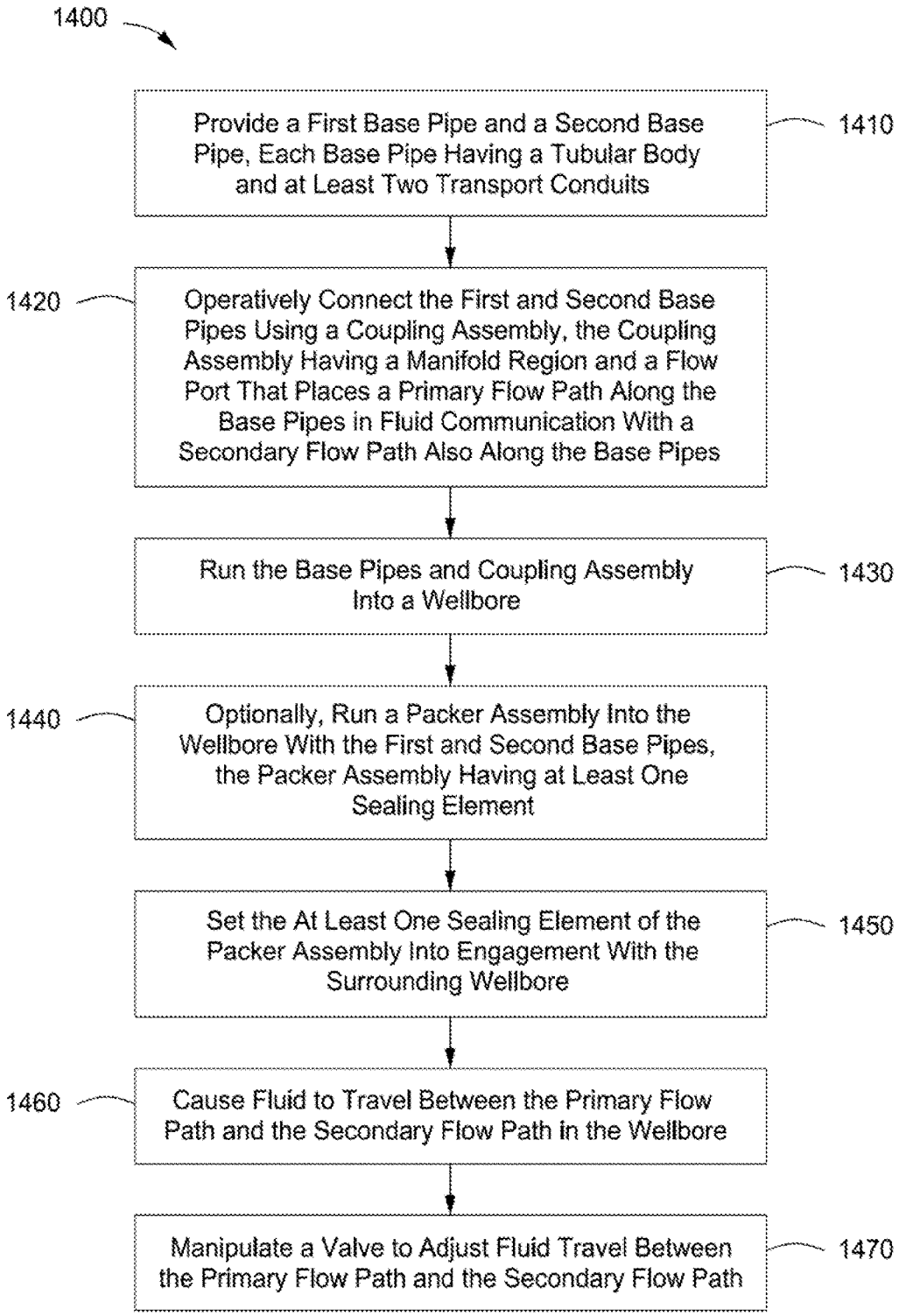
FIG. 14 is a flowchart for a method of completing a wellbore, in one embodiment. The method involves running a joint assembly into a wellbore, and causing fluids to flow between primary and secondary flow paths along the joint assembly.

Based on the above descriptions, a method for completing an open-hole wellbore is provided herein. The method is presented in FIG. 14. FIG. 14 provides a flow chart presenting steps for a method 1400 of completing a wellbore in a subsurface formation, in certain embodiments. The wellbore includes a lower portion completed as an open-hole.

The method 1400 first includes providing a first base pipe and a second base pipe. This is shown at Box 1410. The two base pipes are connected in series. Each base pipe comprises a tubular body. The tubular bodies each have a first end, a second end and a bore defined there between. The bore forms a primary flow path for fluids.

In a preferred embodiment, the tubular bodies comprise perforated base pipes. The base pipes may be, for example, a series of joints threadedly connected to form the primary flow path. Alternatively, the tubular bodies may be blank pipes having a filter medium radially around the pipes and along a substantial portion of the pipes so as to form a sand screen.

Each of the base pipes also has at least two transport conduits. The transport conduits reside along an outer diameter of the base pipes for transporting fluids as a secondary flow path.

The method also includes operatively connecting the second end of the first base pipe to the first end of the second base pipe. This step is shown in Box 1420. The connecting step is done by means of a coupling assembly. In one aspect, the coupling assembly includes a load sleeve, a torque sleeve, and an intermediate coupling joint, with the load sleeve, the torque sleeve and the coupling joint being arranged and connected as described above such as in FIGS. 12A and 12B.

Of note, a flow port resides adjacent the manifold in the coupling joint. The flow port places the primary flow path in fluid communication with the secondary flow path. The manifold region also places respective transport conduits of the base pipes in fluid communication.

Various arrangements for the transport conduits may be used. Preferably, the at least two transport conduits represent six conduits radially disposed about the base pipe. The transport conduits may have different diameters and different lengths.

In one aspect, each of the transport conduits along the second base pipe extends substantially along the length of the second base pipe. In another aspect, each of the transport conduits along the first base pipe extends substantially along the length of the first base pipe, but one of the transport conduits has a nozzle intermediate the first and second ends of the first base pipe. The method then further comprises adjusting the valve to increase or decrease fluid flow through the valve. In still another aspect, at least one of the transport conduits along the first base pipe has an outlet end intermediate the first and second ends of the first base pipe.

In one embodiment, the joint assembly further comprises an inflow control device. The inflow control device resides adjacent an opening in the flow port. The inflow control device is configured to increase or decrease fluid flow through the flow port. The inflow control device may be, for example, a sliding sleeve or a valve. The method may then further comprise adjusting the inflow control device to increase or decrease fluid flow through the flow port. This may be done through a radio frequency signal, a mechanical shifting tool, or hydraulic pressure.

The method 1400 also includes running the base pipes into the wellbore. This is seen at Box 1430.

Optionally, the method 1400 further includes running a packer assembly into the wellbore with the first and second base pipes. This is shown at Box 1440. The packer assembly has at least one sealing element. The packer assembly may be in accordance with the packer assembly 300 described above in connection with FIG. 3A. The packer assembly may include at least one, and preferably two, mechanically-set packers. These represent an upper packer and a lower packer. Each packer will have an inner mandrel, alternate flow channels around the inner mandrel, and a sealing element external to the inner mandrel. Each mechanically-set packer has a sealing element that may be, for example, from about 6 inches (15.2 cm) to 24 inches (61.0 cm) in length. The packers may further have a movable piston housing and an elastomeric sealing element. The sealing element is operatively connected to a piston housing. This means that sliding the movable piston housing along each packer (relative to the inner mandrel) will actuate the respective sealing elements into engagement with the surrounding wellbore.

The method 1400 may further include running a setting tool into the inner mandrel of the packers, and releasing the movable piston housing in each packer from its fixed position. A working line with the setting tool is pulled along the inner mandrel of each packer. This serves to shear the at least one shear pin and shift the release sleeves in the respective packers. Shearing the shear pin allows the piston housing to slide along the piston mandrel and exert a force that sets the elastomeric packer elements.

A swellable packer element may also be employed intermediate a pair of mechanically-set packers. The swellable packer element is preferably about 3 feet (0.91 meters) to 40 feet (12.2 meters) in length. In one aspect, the swellable packer element is fabricated from an elastomeric material. The swellable packer element is actuated over time in the presence of a fluid such as water, gas, oil, or a chemical. Swelling may take place, for example, should one of the mechanically-set packer elements fails. Alternatively, swelling may take place over time as fluids in the formation surrounding the swellable packer element contact the swellable packer element.

In any instance, the method 1400 will then also include setting the at least one sealing element. This is provided at Box 1440.

The method 1400 additionally includes causing fluid to travel between the primary flow path and the secondary flow path. This is indicated at Box 1460. Causing fluid to travel may mean producing hydrocarbon fluids. In this instance, fluids travel from at least one of the transport conduits in the annulus into the base pipes. Alternatively, causing fluid to travel may mean injecting an aqueous solution into the formation surrounding the base pipes. In this instance, fluids travel from the base pipes and into at least one of the transport conduits. Alternatively still, causing fluid to travel may mean injecting a treatment fluid into the formation. In this instance, fluids such as acid travel from the base pipes and into at least one of the transport conduits, and then into the formation. The treatment fluid may be, for example, a gas, an aqueous solution, steam, diluent, solvent, fluid loss control material, viscosified gel, viscoelastic fluid, chelating agent, acid, or a chemical consolidation agent. In all instances, fluids travel through the at least one flow port along the coupling joint.

The above method 1400 may be used to selectively produce from or inject into multiple zones. This provides enhanced subsurface production or injection control in a multi-zone completion wellbore. Further, the method 1400 may be used to inject a treating fluid along an open-hole formation in a multi-zone completion wellbore.

While it will be apparent that the inventions herein described are well calculated to achieve the benefits and advantages set forth above, it will be appreciated that the inventions are susceptible to modification, variation and change without departing from the spirit thereof. Improved methods for completing an open-hole wellbore are provided so as to seal off one or more selected subsurface intervals. An improved zonal isolation apparatus is also provided. The inventions permit an operator to produce fluids from or to inject fluids into a selected subsurface interval.

What is claimed is:

1. A method for completing a wellbore in a subsurface formation, the method comprising:

providing a first base pipe and a second base pipe, with each base pipe comprising:

a tubular body having a first end, a second end and a bore there between forming a primary flow path; and at least two transport conduits along an outer diameter of the tubular body for transporting fluids as a secondary flow path;

operatively connecting the second end of the first base pipe to the first end of the second base pipe by means of a coupling assembly, the coupling assembly comprising providing;

a manifold region that forms at least a portion of the secondary flow path by fluidly communicating each of the transport conduits from the first base pipe with each of the transport conduits of the second base pipe, a coupling joint comprising a main tubular body defining a bore in fluid communication with the primary flow path of the first base pipe and the second base pipe, the main tubular body having a first end and a second end, wherein the first end is threadedly connected to the second end of the first base pipe, and the second end is threadedly connected to the first end of the second base pipe;

a flow port that places at least a portion of the primary flow path in fluid communication with the manifold region of the secondary flow path;

a load sleeve mechanically connected proximate to the first end of the second base pipe; and a torque sleeve mechanically connected proximate to the second end of the first base pipe;

coupling the first base pipe, the coupling assembly, and the second base pipe respectively in series with the coupling assembly intermediate the first base pipe and second base pipe;

running the coupled first base pipe, the coupling assembly, and the second base pipe into the wellbore; and causing fluid to travel between the primary and secondary flow paths through the flow port.

2. The method of claim 1, wherein each of the tubular bodies comprise perforated base pipes.

3. The method of claim 2, wherein each of the base pipes comprises a series of perforated joints threadedly connected to form the primary flow path.

4. The method of claim 1, wherein:

the load sleeve and the torque sleeve each comprises:

a tubular body defining an inner bore therein in fluid communication with the primary flow path, and transport conduits disposed longitudinally along the tubular body in fluid communication with the secondary flow path; and the coupling joint further comprises:

a coaxial sleeve positioned around the tubular body, the sleeve forming an annual region between the tubular body and the sleeve, with the annular region defining the manifold, and the manifold placing the transport conduits of the load sleeve and of the torque sleeve in fluid communication.

5. The method of claim 4, wherein the flow port comprises (i) a through opening in the tubular body of the coupling joint, (ii) a through-opening in the second end of the first tubular body, (iii) a through-opening in the first end of the second tubular body, or (iv) combinations thereof.

6. The method of claim 1, wherein each of the tubular bodies comprise blank, perforated, or slotted pipes having a filter medium radially around the base pipe and along a substantial portion of the base pipe so as to form a sand screen.

7. The method of claim 6, wherein the filtering medium of each sand screen comprises a wire-wrapped screen, a slotted liner, a ceramic screen, a membrane screen, an expandable screen, a sintered metal screen, a wire-mesh screen, a shape memory polymer, or a pre-packed solid particle bed.

8. The method of claim 1, wherein each of the at least two transport conduits along the second base pipe extends substantially along the length of the second base pipe.

9. The method of claim 1, wherein each of the at least two transport conduits along the first base pipe extends substantially along the length of the first base pipe, but one of the at least two transport conduits has a nozzle intermediate the first and second ends of the first base pipe.

10. The method of claim 9, wherein:

the nozzle comprises a valve; and the method further comprises adjusting the valve to increase or decrease fluid flow through the valve.

11. The method of claim 1, wherein at least one of the at least two transport conduits along the first base pipe has an outlet end intermediate the first and second ends of the first base pipe.

12. The method of claim 1, wherein the at least two transport conduits have different inner diameters.

13. The method of claim 1, further comprising:

producing hydrocarbon fluids through the base pipe of the first and second base pipes from at least one interval along the wellbore, wherein producing hydrocarbon fluids causes hydrocarbon fluids to travel from the secondary flow path to the primary flow path.

14. The method of claim 1, further comprising:

injecting a fluid through the base pipe and into the wellbore along at least one interval, wherein injecting the fluid causes fluids to travel from the primary flow path to the secondary flow path.

15. The method of claim 14, wherein the fluid comprises a gas, an aqueous solution, steam, diluent, solvent, fluid loss control material, viscosified gel, viscoelastic fluid, chelating agent, acid, or a chemical consolidation agent.

16. The method of claim 1, further comprising:

placing a plug into the wellbore downstream from the first and second base pipes.

17. The method of claim 1, further comprising:

providing a packer assembly comprising:

at least one sealing element, an inner mandrel, and transport conduits extending substantially along the inner mandrel; and operatively connecting the packer assembly to the first end of the first base pipe such that the transport conduits of the packer assembly are in fluid communication with the transport conduits of the base pipes;

and wherein the step of running the base pipes and connected joint assembly into the wellbore further comprises running the packer assembly into the wellbore; and the method further comprises setting the at least one sealing element into engagement with the surrounding wellbore.

18. The method of claim 17, wherein:

the packer assembly comprises a mechanically set packer; and setting the sealing element comprises setting the mechanically-set packer into engagement with the surrounding open-hole formation.

19. The method of claim 1, wherein the transport conduits of the load sleeve and the transport conduits of the torque sleeve each defines about six transport conduits placed within and radially around its corresponding tubular body.

20. The method of claim 1, wherein:

the coupling assembly further comprises an inflow control device adjacent an opening in the flow port; and the method further comprises adjusting the inflow control device to increase or decrease fluid flow through the flow port.

21. The method of claim 20, wherein the inflow control device is controlled by a radio frequency signal, a mechanical shifting tool, or hydraulic pressure.

22. A joint assembly residing within a wellbore, comprising:

a first base pipe and a second base pipe connected in series, each base pipe comprising:

a tubular body having a first end, a second end and a bore there between forming a primary flow path for fluids; and at least two transport conduits along an outer diameter of the tubular body configured to transport fluids as a secondary flow path;

a coupling assembly operatively connecting the second end of the first base pipe in series to the second first end of the first second base pipe, wherein the coupling assembly comprises;

a manifold region that forms at least a portion of the secondary flow path by fluidly communicating each of the transport conduits from the first base pipe with each of the transport conduits of the second base pipe, an intermediate coupling joint comprising a main tubular body defining a bore in fluid communication with the primary flow path of the first base pipe and the second base pipe, the main tubular body having a first end and a second end, wherein the first end is threadedly connected to the second end of the first base pipe, and the second end is threadedly connected to the first end of the second base pipe; and a flow port that places at least a portion of the primary flow path in fluid communication with the manifold region of the secondary flow path, wherein fluid travels between the primary flow path and secondary flow paths through the flow port;

a load sleeve mechanically connected proximate to the first end of the second base pipe; and a torque sleeve mechanically connected proximate to the second end of the first base pipe;

wherein the first base pipe, the coupling assembly, and the second base pipe are respectively connected in series such that the primary flow path is in fluid communication with the secondary flow paths via the flow port and the manifold region.

23. The joint assembly of claim 22, wherein:

the load sleeve and the torque sleeve each comprises:

a tubular body defining an inner bore therein in fluid communication with the primary flow path, and transport conduits disposed longitudinally along the tubular body in fluid communication with the secondary flow path; and the coupling joint further comprises:

a coaxial sleeve positioned around the tubular body, the sleeve forming an annual region between the tubular body and the sleeve, with the annular region defining the manifold, and the manifold placing the transport conduits of the load sleeve and of the torque sleeve in fluid communication.

24. The joint assembly of claim 23, wherein the flow port comprises (i) a through opening in the tubular body of the coupling joint, (ii) a through-opening in the second end of the first tubular body, (iii) a through-opening in the first end of the second tubular body, or (iv) combinations thereof.

25. The joint assembly of claim 24, wherein each of the tubular bodies comprise perforated base pipe.

26. The joint assembly of claim 24, wherein each of the base pipes comprises a series of joints threadedly connected to form the primary flow path.

27. The joint assembly of claim 24, wherein each of the tubular bodies comprise blank, perforated, or slotted pipe having a filter medium radially around the pipe and along a substantial portion of the pipe so as to form a sand screen.

28. The joint assembly of claim 24, wherein the filtering medium of each sand screen comprises a wire-wrapped screen, a slotted liner, a ceramic screen, a membrane screen, an expandable screen, a sintered metal screen, a wire-mesh screen, a shape memory polymer, or a pre-packed solid particle bed.

29. The joint assembly of claim 24, wherein each of the at least two transport conduits along the second base pipe extends substantially along the length of the second base pipe.

30. The joint assembly of claim 24, wherein each of the at least two transport conduits along the first base pipe extends substantially along the length of the first base pipe, but one of the at least two transport conduits has a nozzle intermediate the first and second ends of the first base pipe.

31. The joint assembly of claim 30, wherein at least one of the at least two transport conduits along the first base pipe has an outlet end intermediate the first and second ends of the first base pipe.

32. The joint assembly of claim 24, further comprising:

a packer assembly comprising:

at least one sealing element, an inner mandrel, and transport conduits extending substantially along the inner mandrel; and wherein the packer assembly is operatively connected to the first end of the first base pipe such that the transport conduits of the packer assembly are in fluid communication with the transport conduits of the base pipe.

33. The joint assembly of claim 32, wherein the packer assembly comprises a mechanically set packer, a swellable packer, or a combination thereof.

34. The joint assembly of claim 24, wherein:

the coupling joint further comprises an inflow control device adjacent an opening in the flow port configured to increase or decrease fluid flow through the flow port.

35. The joint assembly of claim 24, wherein the flow port defines an inflow control device.

36. The joint assembly of claim 26, wherein:

opposing ends of the co-axial sleeve have respective shoulders that land on the load sleeve and the torque sleeve; and the joint assembly further comprises sealing rings to provide a fluid seal of the annular region around the respective shoulders.

37. The joint assembly of claim 36, wherein:

the load sleeve is mechanically connected to the second base pipe by means of bolts;

the torque sleeve is mechanically connected to the first base pipe by means of bolts; and the coaxial sleeve is mechanically connected to the main tubular body by means of bolts, such that the manifold is in fixed position.

* * * * *